US006112690A

United States Patent [19]

Anderson

[11] Patent Number: 6,112,690

[45] Date of Patent: Sep. 5, 2000

[54] WATERCRAFT DOCKING SYSTEM

[76] Inventor: Charles Anderson, HC R2 Box 121, Bigfork, Minn. 56628

[21] Appl. No.: 09/072,036

[22] Filed: May 4, 1998

[51] Int. Cl.[7] ..... B63B 59/02

[52] U.S. Cl. ..... 114/220; 114/219; 405/213

[58] Field of Search ..... 114/263, 219, 114/220, 230.1, 230.19, 230, 15; 405/212–214

[56] References Cited

U.S. PATENT DOCUMENTS 3,145,685 8/1964 Kulick, Sr. ..... 114/220
5,113,702 5/1992 Capps ..... 114/219

OTHER PUBLICATIONS

Overton's—Discount Boating Accessories Catalog, pp. 2, 57–64, (1998).

*Primary Examiner*—Ed Swinehart
*Attorney, Agent, or Firm*—Schwegman, Lundberg, Woessner & Kluth, P.A.

[57] ABSTRACT

A watercraft docking system for receiving watercraft along side of a dock. The watercraft docking system having a first and a second support member which are coupled to an elongated roller to allow the elongated roller to rotate on the longitudinal axis. The watercraft docking system is mounted on a dock, where the dock has a support structure and a dock platform having a walking surface. The first and second support members are secured to the support structure to hold the elongated roller at a predetermined distance from the dock.

20 Claims, 19 Drawing Sheets

WATERCRAFT DOCKING SYSTEM

TECHNICAL FIELD

The invention relates generally to watercraft and more particularly to apparatus for protecting the exterior surface of watercraft.

BACKGROUND OF THE INVENTION

Pleasure boating is a relaxing and enjoyable hobby. Whether it is a fishing boat, a cruiser, or a sail boat people enjoy the serenity and the calming effects of being on the water. The price of a boat, however can be quite expensive. A typical boat can cost from several hundred to tens of thousands of dollars. As a result, boat owners tend to take good care of their boats, so the boat can be enjoyed for many years. Some boat owners naturally take extremely good care of their boats.

One aspect of boating care is to secure the boat to a dock so that exterior damage to the boat is minimized. A dock is a structure that extends from the land out over the surface of the water and it allows boaters to get in and out of a boat without having to step into the water. However, simply securing the boat to the dock can potentially damage to the boat's exterior surface. For example, whether a boat hull is made of fiberglass, aluminum or wood, the exterior surface of the hull is prone to scratching. In addition, these surfaces may be painted or varnished, and/or have decorative and identifying decals. All of these surface treatments, along with the underlying material, may be damaged if the boat directly contacts the dock.

There have been various attempts to prevent boats from coming into contact with docks. One attempt has been to place automobile tires around the outer edge of the dock. A boat landing at the dock would then contact a rubber tire instead of the dock itself. Automobile tires, however, rub against the boat while landing, and while the boat is tied to the dock. The result is that many times automobile tires leave marks on the hull that are difficult to remove. In addition, the use of automobile tires is not aesthetically pleasing since tires on the post of a dock do not look good.

Another way to protect boat hulls is to provide resilient foam or plastic cylindrical buoys suspended either over the edge of the dock or the boat. These buoys are intended to prevent the exterior surface of the boat from contacting the dock either while landing the boat or while the boat is tied to the dock. There are problems with these buoys. The buoys are not stable. In windy conditions the buoys may end up laying on the dock or inside the boat. As a result, the exterior surface of the boat hull is left totally unprotected Another aspect of careful boat handling is in landing the boat at the dock. In approaching the dock the boat driver must take care to avoid many potential obstacles. These obstacles include other boats, objects floating in the water, and objects that may be under the surface of the water, such as rocks and even the lake bottom. Not only must the boat driver avoid these objects he or she must also take care not to steer the boat too close to the edge of the dock. Directly hitting the dock can cause damage to both the boat hull and to the dock. As noted, automobile tires can mar the surface of the boat as it slides up against tires during a landing. Also, if buoys are used, they are prone to rolling from their position between the boat and the dock. The boat can then contact the dock, resulting in damage to the boat. As a result, there is a need for a system to protect boats from damage while landing the boat or while the boat is secured to a dock.

SUMMARY OF THE INVENTION

The present invention provides a watercraft docking system that protects watercraft, including boats, from hull damage caused by a dock when the watercraft is either secured to or landing at the dock. In addition, the present invention, unlike automobile tires or plastic buoys, does not need to be removed from the dock when the dock is moved, such as removing the dock from the lake for the winter. The watercraft docking system is adjustable and accommodates a variety of watercraft, including boats, pontoon boats, sail boats, float planes, and personal watercraft (e.g., a Jet-Ski). Furthermore, the docking system is aesthetically pleasing.

The present invention is a watercraft docking system for receiving watercraft along side of a dock. The watercraft docking system has a first and a second support member which are coupled to an elongated roller to allow the elongated roller to rotate on the longitudinal axis. The watercraft docking system is mounted on a dock, where the dock has a support structure and a dock platform having a walking surface. The first and second support members are secured to the support structure to hold the elongated roller at a predetermined distance from the dock.

In one embodiment, the watercraft docking system of the present invention includes an elongated roller rotatably supported at its opposite ends by a first support member and a second support member in such a manner as to allow the elongated roller to rotate about its central longitudinal axis.

In an additional embodiment, the watercraft docking system is used on or coupled to a dock, where the dock has a dock platform with a walking surface. The first support member and the second support member of the watercraft docking system are secured to the support structure of the dock to hold the elongated roller with its axis generally vertical at a predetermined distance from the dock. As a watercraft comes into contact with the elongated roller, the elongated roller turns, or rotates, on its central longitudinal axis allowing the watercraft to be positioned along side the dock while preventing the boat from coming into direct contact with the dock. In one embodiment, the support structure of the dock includes poles positioned essentially perpendicular to the walking surface of the dock platform, with the support members secured to and generally parallel to the pole.

In an additional embodiment, the first and second support members are adapted to allow the elongated roller to be adjustably positioned away from the dock, thereby allowing the elongated roller to be positioned at a variety of predetermined distances from the dock. In an additional embodiment, the first and second support member are adjusted so that the elongated roller is tilted relative to the dock. In one embodiment, the elongated roller is tilted so that the longitudinal axis of the elongated roller is at an angle in the range of approximately 0 to 15 degrees with respect to the axis of the pole. Tilting of the elongated rollers allows for different types and shapes of watercraft to be accommodated along side of a dock.

In one embodiment, the first support member and the second support member each include a mounting bracket, an arm coupled to the mounting bracket, and a rod assembly attached to the arm. The rod assembly includes a shaft which is secured to the arm of the support member. The shaft extends beyond the surface of the arm and is coupled to the elongated roller. The first end and second end of the central portion of the elongated roller can have a circular hole or opening of sufficient size to accommodate the shaft of the first and second support member, respectively. This allows the elongated roller to spin or rotate on the shafts around its longitudinal axis when a sufficient rotational force is applied to the elongated roller.

In one embodiment, the arm coupled to the mounting bracket has a fixed predetermined length. In an additional embodiment, the arm is adjustable so that the elongate roller can be positioned at a variety of distances from the dock. In one embodiment, the adjustable arm includes a tubular arm portion and a receiving arm portion. The tubular arm portion has a tubular arm portion first end and a tubular arm portion second end. The receiving arm portion has a receiving arm portion first end and a receiving arm portion second end. The receiving arm portion first end is secured to the mounting bracket. The tubular arm portion first end is positioned over the receiving arm portion second end and the tubular arm portion slides over the receiving arm portion to adjust the length of the arm. In a further embodiment, the tubular arm portion includes at least the through opening, where the opening is adapted to receive a retaining element. The retaining element allows the length of the arm to be fixed by reversibly engaging the retaining element between the tubular arm portion and the receiving arm portion. In one embodiment, the opening is a threaded opening and the retaining device is a threaded bolt.

In an additional embodiment, the support member further includes a shock absorbing element to cushion the landing and absorb the force of a watercraft pressing against the elongated roller. In one embodiment, the shock absorbing element is a coil spring that is positioned within the support member arm's tubular arm and receiving arm portions. The coil spring provides a compressive resistance to the tubular arm portion as it travels over the receiving arm portion.

BRIEF DESCRIPTION OF THE DRAWINGS

In the drawings where like numerals describe like components throughout the several views.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice and use the invention, and it is to be understood that other embodiments may be utilized and that logical, and structural changes may be made without departing from the spirit and scope of the present invention. The following detailed description is, therefore, not to be taken in a limiting sense and the scope of the present invention is defined by the appended claims and their equivalents.

The embodiments of the present invention illustrated herein are described as being included for use on a dock. However, the watercraft docking system of the present invention could also be useful on any variety of structures, including: slips, rafts, other watercraft (where in one embodiment, the watercraft docking system is removably secured to the watercraft), piers, stationary buoys, boat lifts, support structures for water spanning bridges. In addition, the apparatus of the present invention could be positioned on land to protect vehicles and structures from damage as vehicles are moved in and out of structures such as garages and storage areas.

Figure 1:
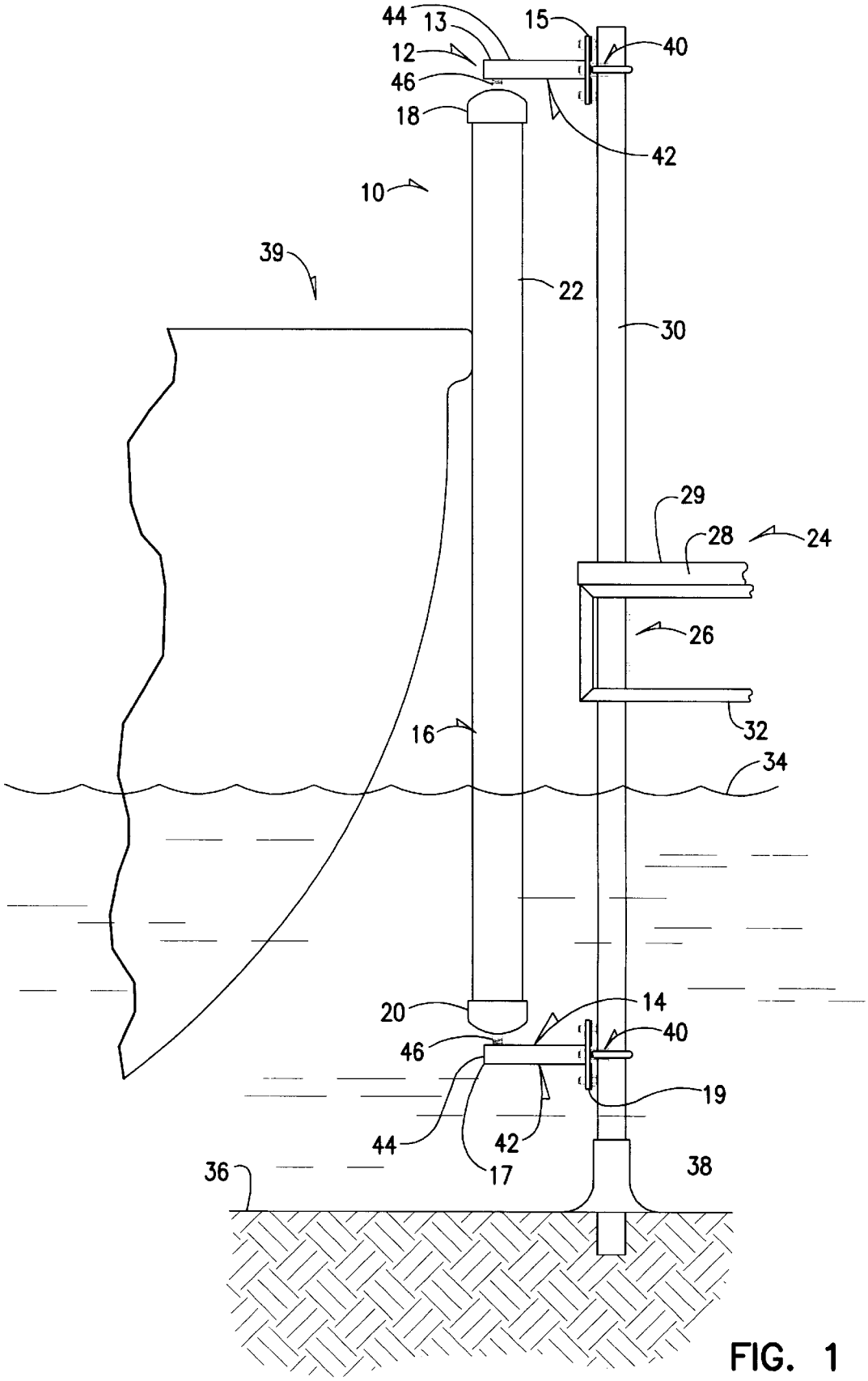
FIG. 1 is a schematic view of one embodiment of a watercraft docking system of the present invention.

Referring now to FIG. 1 of the drawings, there is shown a first embodiment of a watercraft docking system 10 which includes an first support member 12 having a distal end 13 and a proximal end 15, a second support member 14 having a distal end 17 and a proximal end 19, and an elongated roller 16. The elongated roller 16 has an elongated roller first end 18 and an elongated roller second end 20 and a peripheral surface 22. The elongated roller 16 defines a longitudinal axis extending between the elongated roller first end 13 and the elongated roller second end 20.

The elongated roller first end 18 is coupled to and supported by the distal end 13 of the first support member 12 and the elongated roller second end 20 is coupled to and supported by the distal end 17 of the second support member 14. The first support member 12 is coupled to a central portion of the elongated roller first end 18 and the second support member 14 is coupled to the central portion of the elongated roller second end 20. The first and second support members, 12 and 14, are connected to the elongated roller 16 along its longitudinal axis in such a way as to allow the elongated roller 16 to rotate around its longitudinal axis when there is sufficient rotational force applied to the peripheral surface 22 of the elongated roller 16.

The watercraft docking system 10 is secured to a dock 24, where the dock 24 includes a support structure 26 and a dock platform 28, where the dock platform has a walking surface 29. The support structure 26 includes a pole 30 and a dock platform support 32. The pole 30 is positioned essentially perpendicular to the walking surface 29 of the dock platform 28, and extends down into the water 34, resting on the lake bottom 36 through the use of a footing 38. The proximal end 15 of the first support member 12 and the proximal end 19 of the second support member 14 are secured to the support structure 26 and hold the elongated roller 16 at a predetermined distance from the dock 24. The first support member 12 and the second support member 14 are secured in a spaced relationship along the pole 30 of the support structure 26, where the first support member 12 is secured to the pole 30 at a position that is above the surface of the water 34 and the second support member 14 is secured to the pole 30 at a position that is below the surface of the water 34.

A boat 39 is shown in contact with the watercraft docking system 10. Either during landing the boat 39 or when the boat 39 is secured to the dock 24, the outer surface of the boat's hull, or protective rim, contacts the peripheral surface 22 of the elongated roller 16. As the boat 39 move horizontally against the elongated roller 16, the elongated roller 16 rotates around its longitudinal axis. This allows the boat 39 to move relative to the dock 24 without causing damage to the boat hull or protective rim. In addition, the elongated roller 16 is made of a material having a sufficient hardness such that as the boat moves vertically against the elongated roller, the boat hull or protective rim simply slides over its peripheral surface 22. Typically, two or more of the watercraft docking system 10 are attached to a dock 24 in order to provide sufficient contact points for the boat 39 to land against and to be secured to the dock 24.

The elongated roller 26 has a length in the range of approximately 80 to 100 centimeters, 80 to 120 centimeters, 80 to 155 centimeters, 100 to 155 centimeters, or 120 to 155 centimeters. However, any length of elongated roller that is sufficient to provide a contact area for a watercraft is considered within the scope of the present invention. In one embodiment, the elongated roller 16 is tubular, having an essentially cylindrical peripheral surface 22. In an alternative embodiment, the elongated roller 16 has a cross-sectional composition that is solid.

In addition, the elongated roller 16 is constructed of a material that will not cause damage to the hull of a boat, which materials are known in the art. For example, the elongated roller 16 can be constructed of extruded or molded thermoplastics, such as extruded poly(vinyl chloride) (PVC) tubing; extruded rubber, where the rubber has a sufficient stiffness and rigidity to maintain its shape when in contact with a watercraft; flexible rubber, where the elongated roller has a central support shaft which maintains the essential shape of the elongated roller; cast polymer or rubber material; foam rubber or plastic material; or any material having sufficient stiffness and resilience so that the elongated roller will not be so flexible that its peripheral surface 22 will come into contact with the dock support structure or with the surface of the dock due to the impact from a boat landing at a dock.

Support Member

Figure 2:
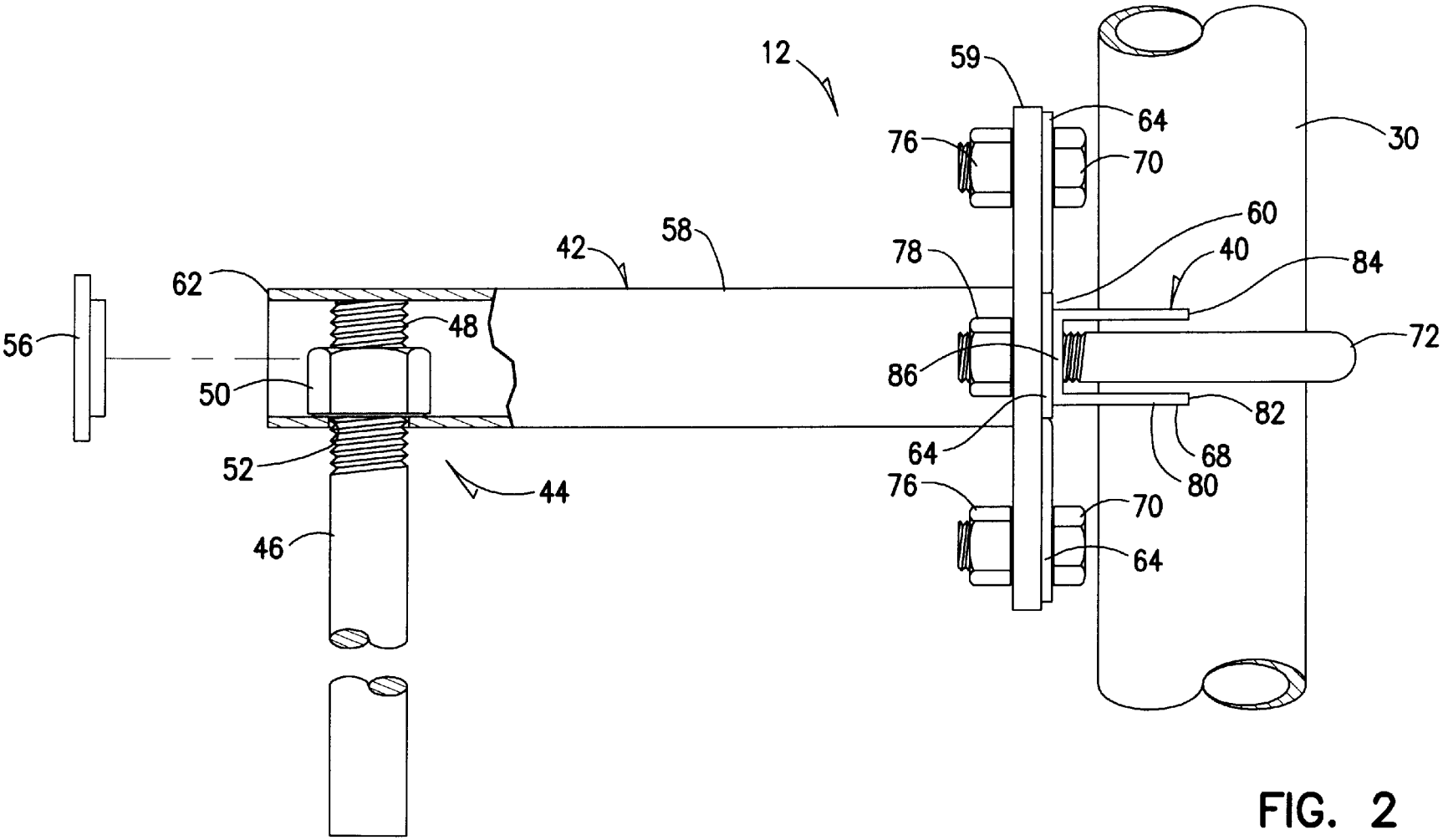
FIG. 2 is a cross-sectional schematic view of one embodiment of a support member according to the present invention.
Figure 3:
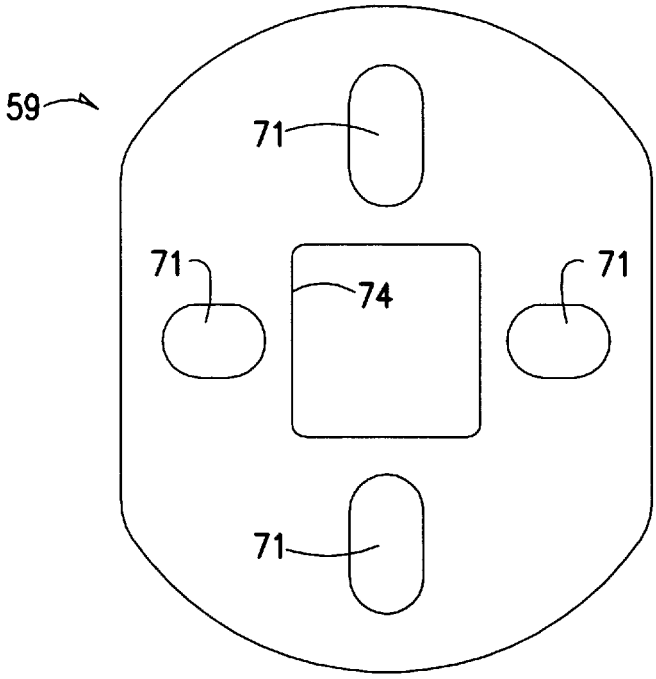
FIG. 3 is a schematic view of one embodiment of a mounting plate according to the present invention.
Figure 4:
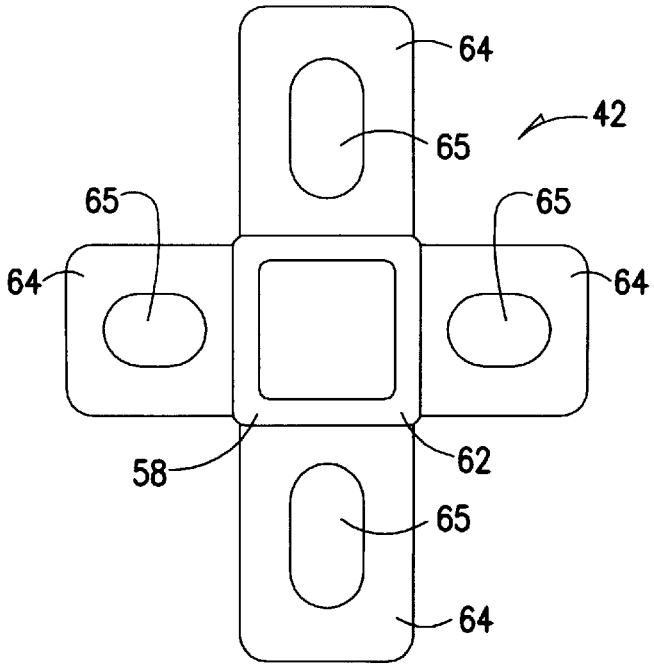
FIG. 4 is a schematic view of one embodiment of a support member arm according to the present invention.

Referring now to FIGS. 2 to 4, there is shown a first embodiment of the first support member 12 and the second support member 14 of the watercraft docking system 10. The first and second support member, 12 and 14, each include a mounting bracket 40 at the proximal ends 15 and 19, an arm 42 coupled to the mounting bracket 40, and a rod assembly 44 attached to the arm 42 at the distal ends 13 and 17. The rod assembly 44 includes a shaft 46, where the shaft 46 extends from the arm 42 and is adapted to be inserted into an opening in the central portion of the elongated roller first end 18 and into an opening in the central portion of the elongated roller second end 20. In one embodiment, the elongated roller first end and second end, 18 and 20, each have a circular hole or opening which is adapted to receive the shaft 46 of the rod assembly 44. In one embodiment, the shaft 46 has a length in the range of approximately 10 to 20 centimeters.

The shaft 46 is a cylinder having a threaded portion 48 and a lock nut 50. The arm 42 has a tubular cross sectional shape, and includes a first threaded opening 52. The first threaded openings 52 is adapted to receive the threaded portion 48. As the threaded portion 48 is brought through the first threaded opening 52, the lock nut 50 is screwed onto threaded portion 48 of the shaft 46. The threaded portion 48 is then advanced until the end of the shaft abuts the inside surface of the arm 42. The lock nut 50 is then tightened down upon the inside surface of the arm 42 to secure the shaft 46 to the arm 42. An end cap 56 is then positioned over or within the arm 42.

The shaft 46 of the first support member 12 and the second support member 14 is positioned within the openings in the elongated roller first and second end, 18 and 20. In one embodiment, the elongated roller first end and second end, 18 and 20, have a semi-spherical end cap, where the semi-spherical end cap is made of extruded PVC tubing. Openings are then created in the central portions of the elongated roller first end and second end, 18 and 20, along the longitudinal axis of the elongated roller 16. In an alternative embodiment, the elongated roller first end has a flat planar end cap which is secured at the elongated roller first end. In a similar manner an opening is created through a central portion of the flat planar end cap along the longitudinal axis of the elongated roller.

The openings are circular having diameters that are larger than the diameter of the shaft 46 of the first support member 12 and the second support member 14. This provides a sufficient space between the peripheral surface of the shaft 46 and the wall of the cylindrical opening at the elongated roller first end 18 and elongated roller second end 20 to allow the elongated roller 16 to turn or rotate around its longitudinal axis. In an alternative embodiment, the opening of the elongated roller first end and second end, 18 and 20, further include a sleeve or grommet inserted into the opening to protect the openings. In an additional embodiment, the opening of the elongated roller first end and second end, 18 and 20, further include a roller bearing having a central opening adapted to receive the rod from the support member, where an outer circumferential surface of the roller bearing is seated in the openings at the elongated roller first end and second end, 18 and 20. In an additional embodiment, a friction clutch, as are known in the art, can be added to the elongated roller first end 18 and/or second end 20 to provide a braking effect to the rotation of the elongated roller 16.

Arm 42 includes a single elongated body 58 having a flanged first end 60 and a second end 62. The flanged first end 60 includes retaining arms 64, which extend perpendicularly from the single elongated body 58, each arm including an opening 65. In one embodiment, the single elongated body 58 is a length of tubular metal or plastic having a flanged first end 60 as is known in the art. The single elongated body 58 is coupled to the mounting bracket 40 and supports the rod assembly 44. The mounting bracket 40 includes a mounting plate 59, a U-bolt assembly 68, and a securing bolt 70. The mounting plate 59 has bolt openings 71 adapted to receive the arms of the U-bolt 72 and the securing bolt 70. Additionally, the mounting plate 59 includes an elongated body opening 74 which has a shape and dimension adapted to receive the single elongated body 58. The single elongated body 58 is inserted into the elongated body opening 74 until the flanged first end 60 contacts the mounting plate 59. Each opening 65 on the arm 42 is then aligned with bolt openings 71 on the mounting plate 59. The securing bolt 70 is then passed through one of opening 65 and bolt openings 71 and the mounting plate 59 and the single elongated body 58 are secured together with a nut 76. In one embodiment, the elongated body opening 74 is adapted to receive an elongated body 58 having either a 3.175 centimeter (1.25 inch) or a 5.08 centimeter (2 inch) square tubular cross sectional profile.

Alternatively, the mounting plate 59 and the single elongated body 58 are welded (chemically or electrically) or braised together as is known in the art. The arm 42 is a length of tubular metal or plastic that is chemically or electrically welded or braised directly to the mounting plate 59. In an additional embodiment, the arm 42 a metal or plastic bar which is coupled to the mounting bracket 40 and supports the rod assembly 44. The single elongated body 58 has a length in the range of approximately 10 to 30 centimeters.

The U-bolt assembly 68 includes the U-bolt 72, U-bolt nuts 78 and a U-bolt bracket 80. The U-bolt bracket 80 includes a first side 82 and a second side 84 having an arcuvet configuration that is adapted to receive the pole 30. The first side 82 and the second side 84 are perpendicularly attached to a third side 86. The third side 86 includes openings which aline with bolt openings 71 on the mounting plate 59. The arm 42 is secured to the pole 30 by placing the U-bolt 72 around the pole 30, inserting the arms of the U-bolt 72 through the aligned openings of the third side 86 and the bolt openings 71 and then tightening the support member to the pole 30 with U-bolt nuts 78. In one embodiment, the U-bolt assembly 68 is a muffler clamp as is known in the art.

Adjustable Arm Length

Figure 5:
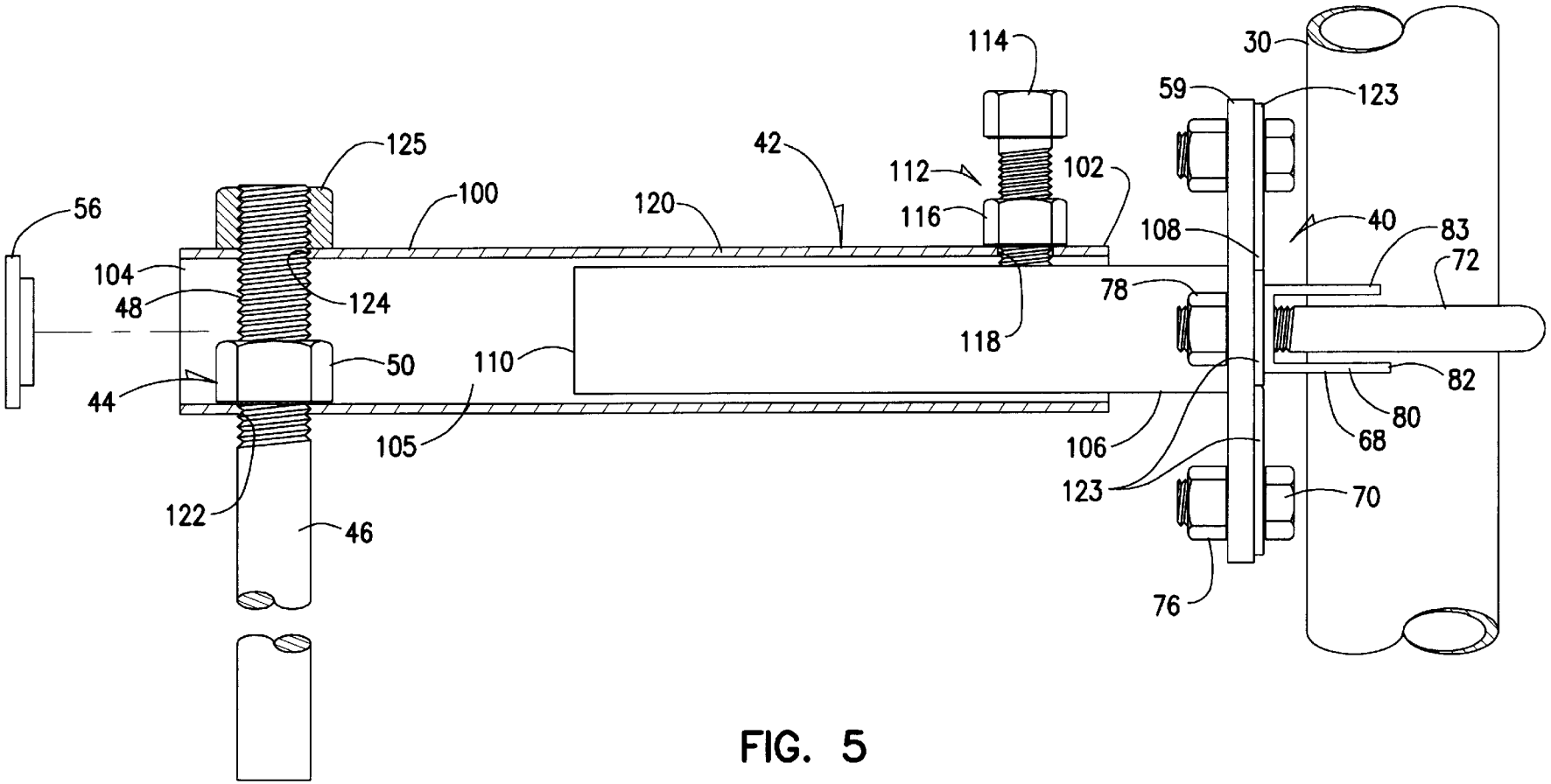
FIG. 5 is a cross-sectional schematic view of one embodiment of a support member according to the present invention.

Referring now to FIG. 5 there is shown an alternative embodiment of the present invention where the length of arm 42 is adjustable. The arm 42 includes a tubular arm portion 100 having a tubular arm portion first end 102 and a tubular arm portion second end 104 and a central opening 105, and a receiving arm portion 106 having a receiving arm portion first end 108 and a receiving arm portion second end 110. The tubular arm portion 100 and the receiving arm portion 106 have cross-sectional shapes and dimensions that permit the receiving arm portion 106 to be slidably received in the central opening 105 of the tubular arm portion 100.

The tubular arm portion 100 is held in place relative to the receiving arm portion 106 through the use of a retaining element 112. In one embodiment, the retaining element 112 is a threaded retaining bolt 114 which is threaded into nut 116. The nut 116 is secured to the tubular arm portion 100, where in one embodiment the nut 116 is welded to the tubular arm portion 100. The tubular arm portion 100 has at least one through opening in wall 120 that is adapted to receive the threaded retaining bolt 114. Upon adjusting the length of the arm 42 by sliding the tubular arm portion 100 relative to the, receiving arm portion 106, the length of the arm 42 is fixed by releasably engaging the threaded retaining bolt 114 against the nut 116 and the receiving arm portion 106.

The shaft 46 is a cylinder having a threaded portion 48 and a lock nut 50 as previously described. The rod assembly 44 is coupled to the tubular arm portion 100 adjacent to the tubular arm portion second end 104. The tubular arm portion 100 includes a first threaded opening 122 and a second opening 124. The first threaded opening and the second openings, 122 and 124, are aligned on opposite sides of the tubular arm portion 100 and are adapted to receive the threaded portion 48. As the threaded portion 48 is, brought through a first threaded opening 122, the lock nut 50 is screwed onto threaded portion 48 of the shaft 46. The threaded portion 48 is then advanced until it passes through the second opening 124. A lock nut 125 is then threaded onto the threaded portion 48 extending above the tubular arm portion 100. Both the lock nut 50 and the lock nut 125 are then tightened down upon the tubular arm portion 100 to secure the shaft 46. The end cap 56 is then positioned over or within the tubular arm portion 100.

Figure 6:
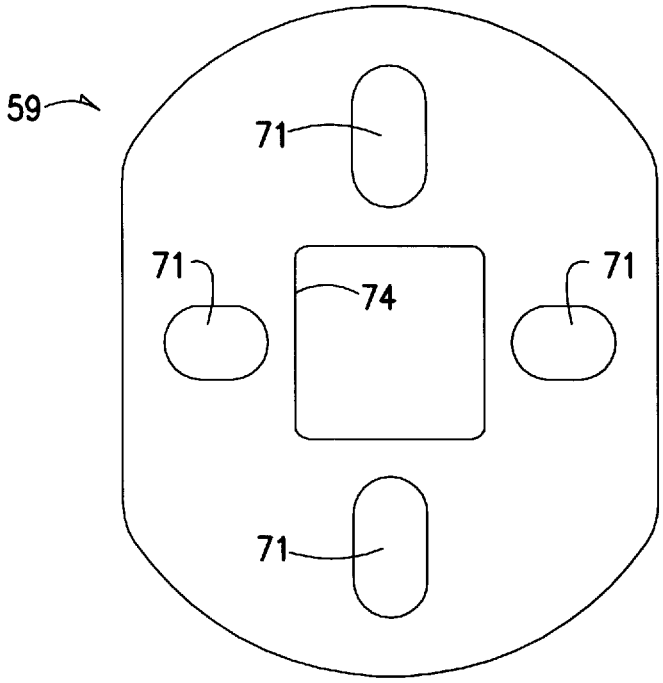
FIG. 6 is a schematic view of one embodiment of a mounting plate according to the present invention.
Figure 7:
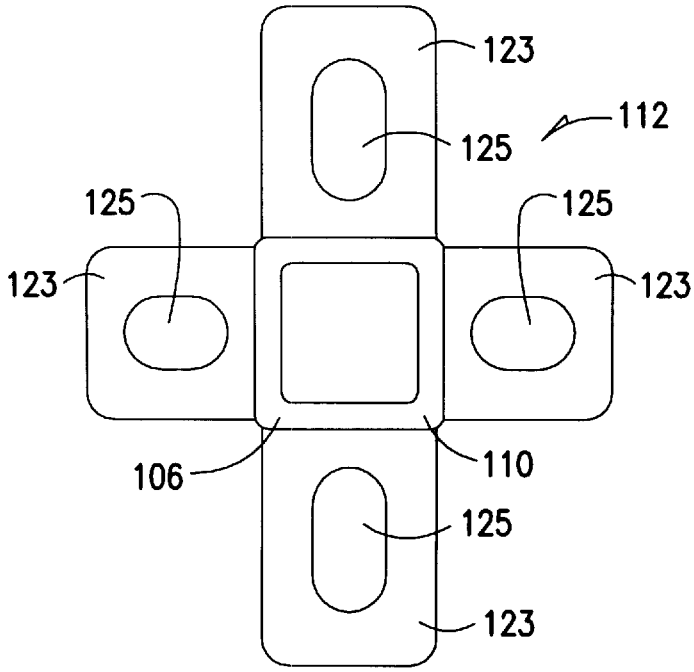
FIG. 7 is a schematic view of one embodiment of a support member arm according to the present invention.

Referring now to FIGS. 6 and 7, there is shown an embodiment of the receiving arm portion 106 and the mounting plate 59. The receiving arm portion first end 108 includes retaining arms 123, which extend perpendicularly from the elongated portion of the receiving arm portion 106. The retaining arms 123 each include an opening 125. In one embodiment, the receiving arm portion 106 is a length of tubular metal or plastic having a flanged first end 60 as is known in the art. The elongated body opening 74 has a shape and dimension adapted to receive the receiving arm portion 106. The receiving arm portion 106 is inserted into the elongated body opening 74 until the retaining arms 123 contacts the mounting plate 59. Each opening 125 on the receiving arm portion 106 is then aligned with bolt openings 71 on the mounting plate 59. The securing bolt 70 is then passed through one of opening 125 and bolt openings 71 and the mounting plate 59 and the receiving arm portion 106 are secured together with a nut 76.

Alternatively, the mounting plate 59 and the retaining arm portion 106 are welded (chemically or electrically) or braised together as is known in the art. The retaining arm portion 106 is a length of tubular metal or plastic that is chemically or electrically welded or braised directly to a mounting plate. In an additional embodiment, the retaining arm portion 106 is a metal, plastic, or rubber bar which is coupled to the mounting plate 59. The retaining arm portion 106 has a length that is between 7 and 45 centimeters.

Figure 8:
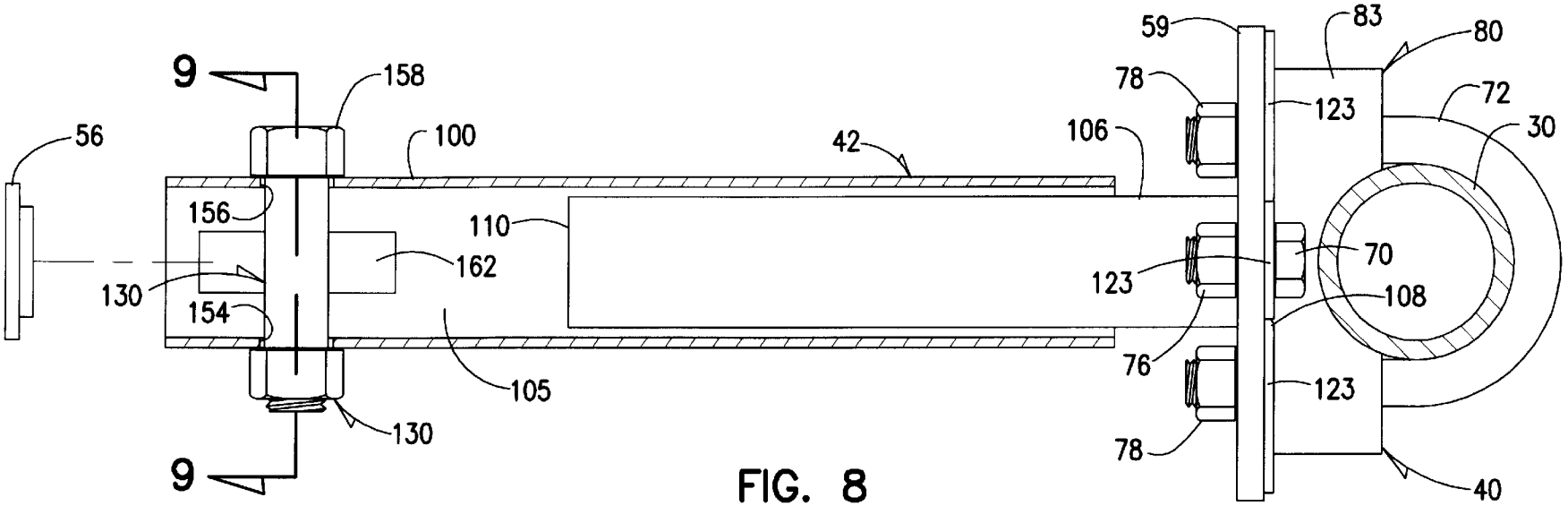
FIG. 8 is a cross-sectional schematic top view of one embodiment of a support member according to the present invention.
Figure 9:
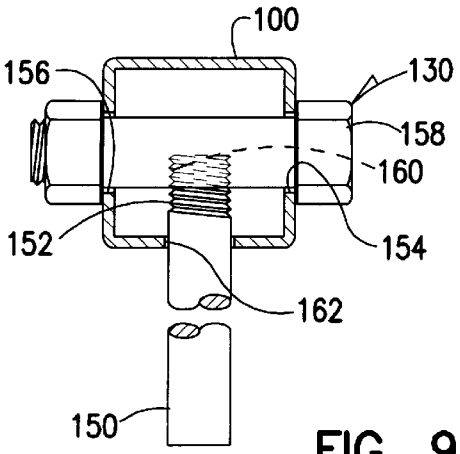
FIG. 9 is a schematic view of one embodiment of a support member rod assembly taken along the lines 9—9 in FIG. 8.

Referring now to FIGS. 8 and 9, there is shown an embodiment of an adjustable first support member 12 and the second support member 14 of the watercraft docking system 10. The support member includes the mounting bracket 40, an arm 42 coupled or secured to the mounting bracket 40, and rod assembly 130 attached to the arm 42.

The rod assembly 130 includes a shaft 150, where the shaft 150 extends from the arm 42 and is adapted to be inserted into the opening in the elongated roller first end 18 and into the opening in the elongated roller second end 20.

The shaft 150 is a cylinder having a threaded portion 152. The tubular arm portion 100 includes a first opening 154 and a second opening 156, where the first and second openings, 154 and 156, are aligned on opposite sides of the tubular arm portion 100 and are adapted to receive a support rod 158. The support rod 158 is a bolt having a threaded portion, where the bolt is inserted through the first opening 154 and the second opening 156 until the head of the bolt abuts the side of the tubular arm portion 100 and the bolt is secured onto the tubular arm portion 100 with a nut threaded and tightened on the threaded portion of the bolt. The bolt further includes a threaded opening 160 that is adapted to receive the threaded portion of the shaft 150. Upon inserting and securing the support rod 158 to the tubular arm portion 100, the threaded portion of the shaft 150 is inserted through an rectangular opening 162 in the tubular arm portion 100. The rectangular opening 162 has its long axis aligned with long axis of the tubular arm portion 100. The shaft 150 is then inserted and tightened into threaded opening 160 to secure the shaft 150 onto the support rod 158. The shaft 150 can pivot on the support rod 158, allowing the shaft 150 to move along a linear path along the longitudinal axis of the tubular arm portion 100.

Tilted Elongated Roller

Figure 10:
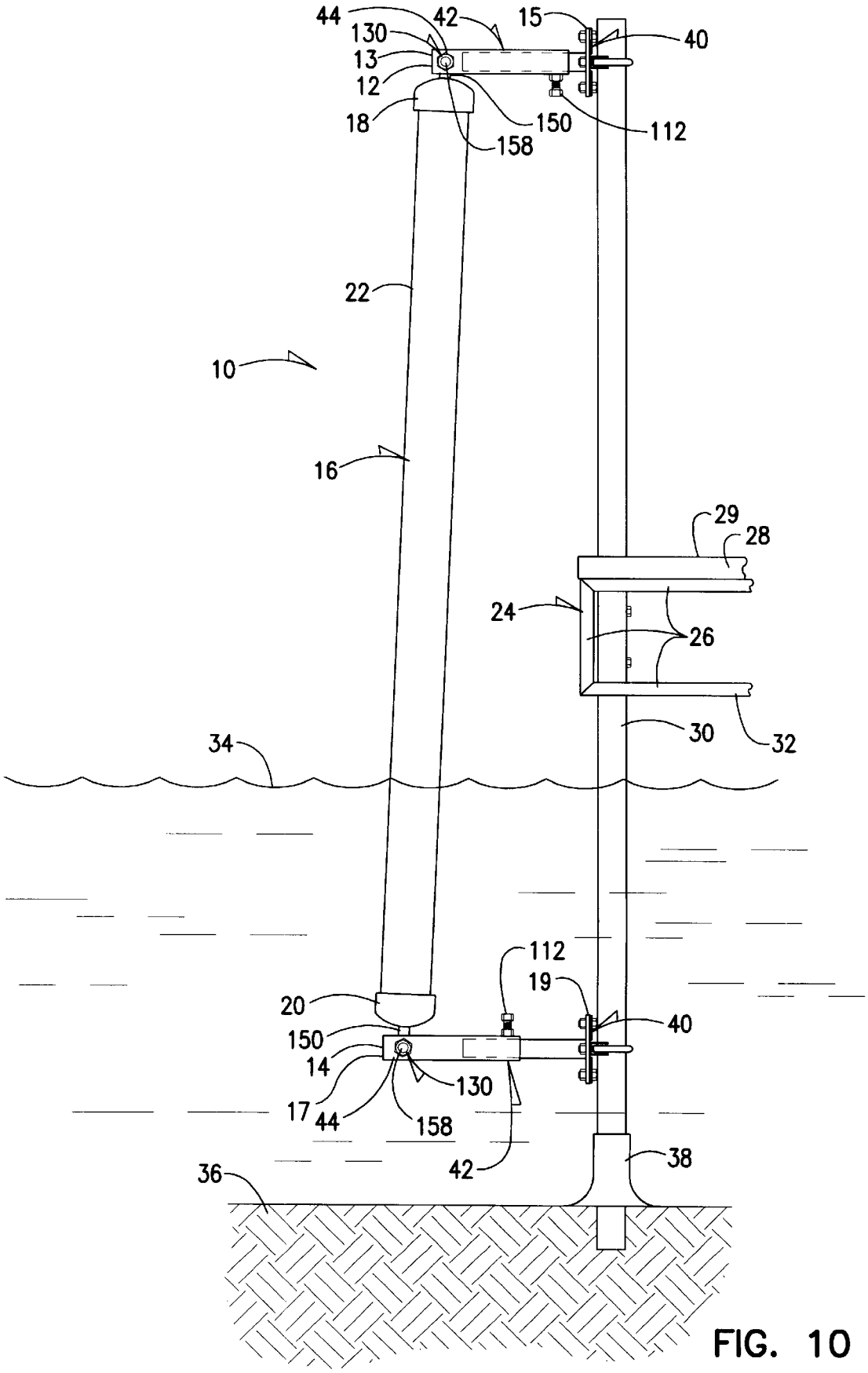
FIG. 10 is a schematic view of one embodiment of a watercraft docking system of the present invention.

Referring now to FIG. 10, there is shown an embodiment of the watercraft docking system 10 where the length of arm 42 for both the first support member 12 and the second support member 14 are adjustable. This adjustability allows the elongated roller 16 to be tilted relative to the dock 24. As the length of arm 42 is adjusted for either the first or second support members, 12 and/or 14, the shaft 150 moves within the rectangular opening 162 as it pivots on the support rod 158. This allow shaft 150 to remain aligned with the longitudinal axis of the elongated roller 16. Once the length of arm 42 has been adjusted for both the first and second support members, 12 and 14, the support rod 158 is then tightened so that the shaft 150 remains aligned within the openings of the elongated roller 16.

The length of the arm 42 for both the first and second support members, 12 and 14, is adjusted to accommodate a variety of watercraft. In the embodiment shown in FIG. 10, the elongated roller 16 is adjusted for receiving and securing of pontoon type watercraft. The length of arm 42 of the second support member 14 is greater than the length of arm 42 of the first support member 12. As a result, the elongated roller second end 20 extends further away from the dock 24 than the elongated roller first end 18. In an alternative embodiment, the length of arm 42 of the second support member 14 is shorter than the length of arm 42 of the first support member 12. As a result, the elongated roller first end 18 extends further away from the dock 24 than the elongated roller second end 20. The longitudinal axis of the elongated roller 16 is at an angle in the range of approximately 0 and 15 degrees with respect to the axis of the pole 30.

Bias Element

Figure 11:
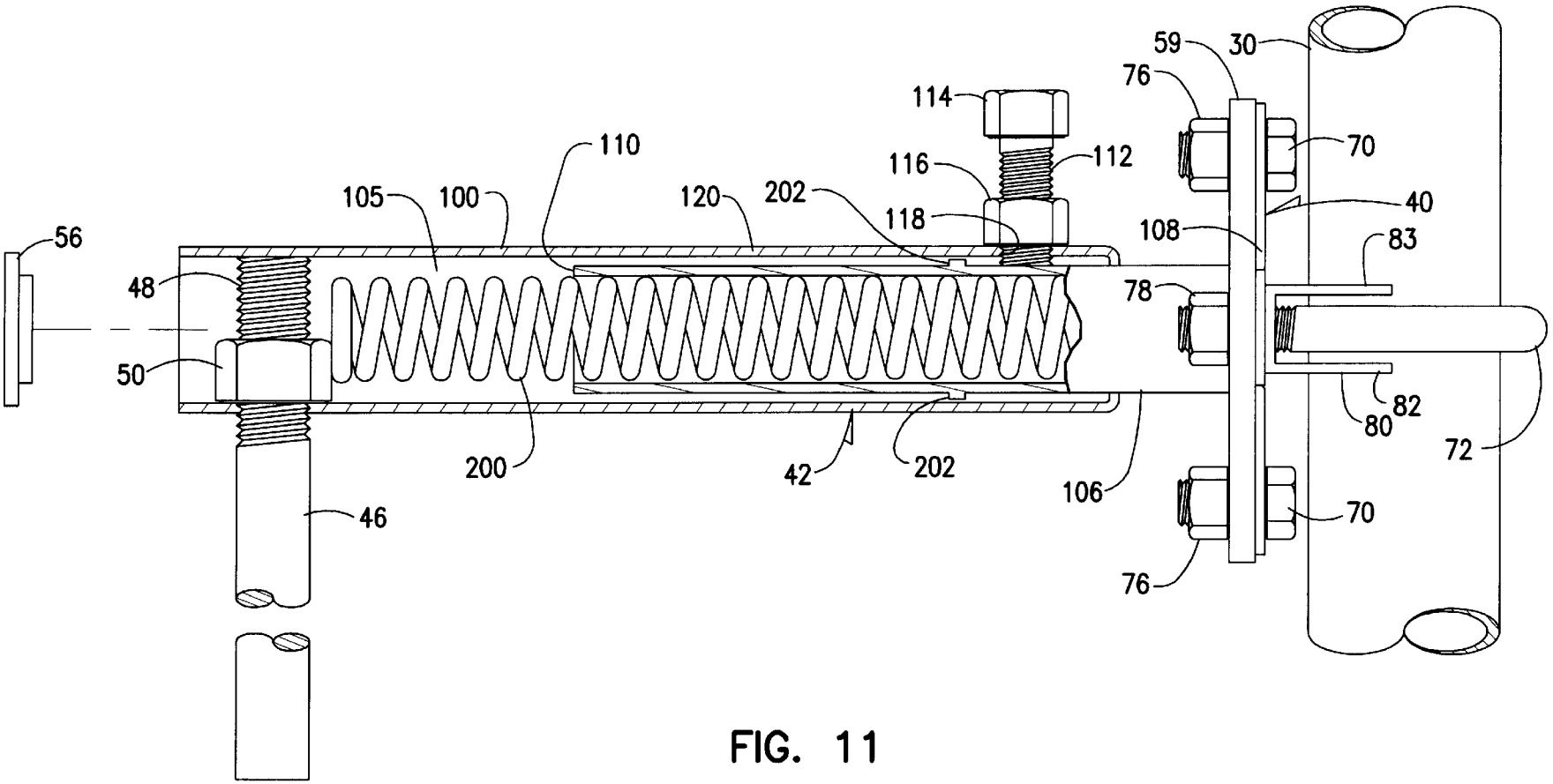
FIG. 11 is a cross-sectional schematic view of one embodiment of a support member according to the present invention.

Referring now to FIG. 11 there is shown an additional embodiment of a support member of the present invention further including a bias element. The bias element is adapted to absorb a portion of the force of a watercraft as it comes into contact with the elongated roller 16. In one embodiment, the bias element is positioned within the arm 42, where the bias element is positioned within the tubular arm portion 100 between the receiving arm portion 106 and the tubular arm portion 100. In one embodiment, the bias element is a coiled spring 200 that is positioned between and within the tubular arm portion 100 and the receiving arm portion 106. In an alternative embodiment, the bias element is a piece of rubber which is positioned between and within the tubular arm portion 100 and the receiving arm portion 106.

The receiving arm portion 106 has a tubular structure. The coil spring 200 is place partially within the tubular structure of the receiving arm portion 106 and the tubular arm portion 100 is placed over both the coil spring 200 and the receiving arm portion 106. The receiving arm portion 106 further includes a retaining ridge 202 extending from a receiving arm exterior surface of the receiving arm portion 106. In one embodiment, the tubular arm portion 100 is positioned so that the retaining element, in one embodiment the threaded retaining bolt 114, is positioned proximal and towards the receiving arm portion first end 108. The threaded retaining bolt 114 is then lowered a sufficient distance so that it laterally abuts the retaining ridge 202, holding the tubular arm portion 100 over the receiving arm portion 106. The tubular arm portion 100 and receiving arm portion 106 are then relatively movable between a first position to which the tubular arm portion and the receiving arm portion are biased by the bias element with the retaining element and the retaining ridge engaged, and a second position with the retaining ridge 202 and the retaining element 112 spaced apart and a longer portion of the receiving arm portion 106 being received in the central opening 105 than in the first position. In one embodiment, the tubular arm portion 100 travels over the receiving arm portion 106 under the resistive force of the coil spring 200 from a first position, where the threaded retaining bolt 114 abuts the retaining ridge 202, to a second position adjacent the mounting plate 59. The coil spring 200 has a spring constant and a length that is sufficient to allow the tubular arm portion to ride over the receiving arm portion under the compressive resistance of the coil spring 200.

Figure 12:
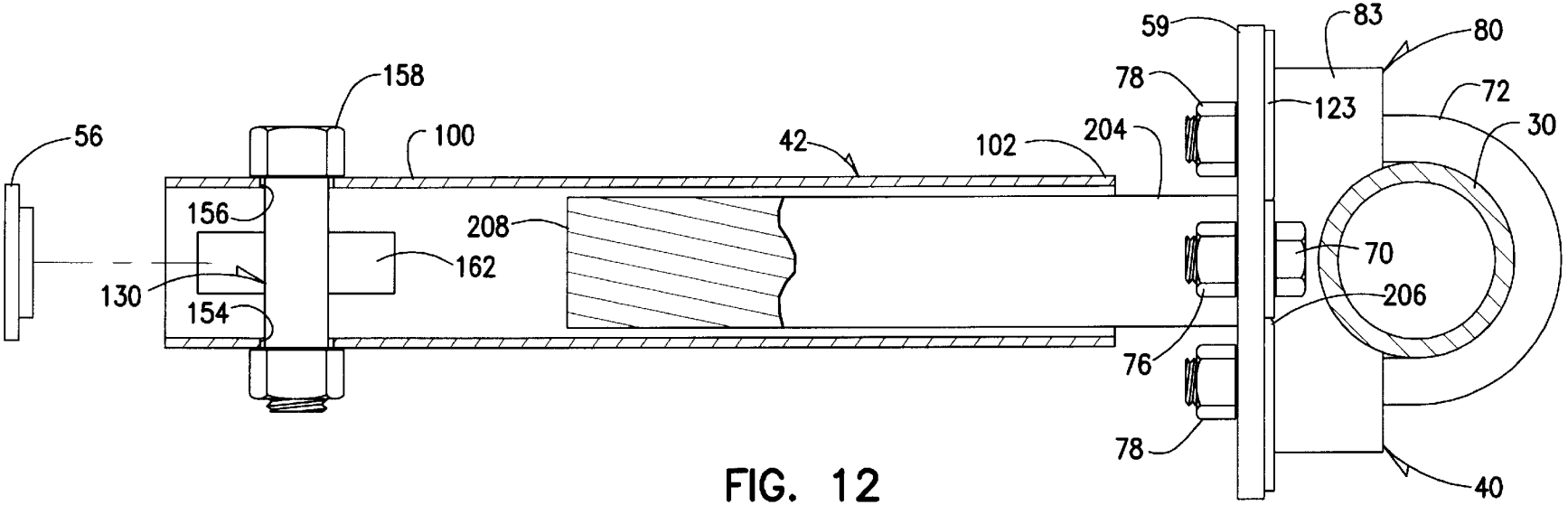
FIG. 12 is a cross-sectional schematic top view of one embodiment of a support member according to the present invention.

Referring now to FIG. 12, there is shown an additional embodiment of a support member according to the present invention. The first support member 12 and the second support member 14 each include a mounting bracket 40, an arm 42 coupled to the mounting bracket 40, and a rod assembly 130 attached to the arm 42. The arm 42 includes a tubular arm portion 100 and a receiving arm portion 204. The receiving arm portion first end 206 is secured to the mounting bracket 40 and the tubular arm portion first end 102 is positioned over the receiving arm portion second end 208, where the length of the arm 42 is adjustable. The tubular arm portion 100 is held in place relative to the receiving arm portion 204 through the use of a retaining element 112 as previously described.

The receiving arm portion 204 is a substantially homogeneous solid flexibly resilient polymer. In one embodiment, the substantially homogeneous solid flexibly resilient polymer is, for example, polyethylene, polypropylene, poly (vinyl chloride), polystyrene, poly(ethylene terephthalate), polybutadiene, polyisoprene (natural rubber), copolymers as are known in the art. However, any polymer or rubber having a stiffness and resiliency to support the arm 42 is considered within the scope of the present invention. In an alternative embodiment, the receiving arm portion 204 is a coil spring, where one end of the coil spring is coupled to the mounting bracket 40, for example by arc or stick welding, and over the other end the tubular arm portion 100 is placed.

Figure 13:
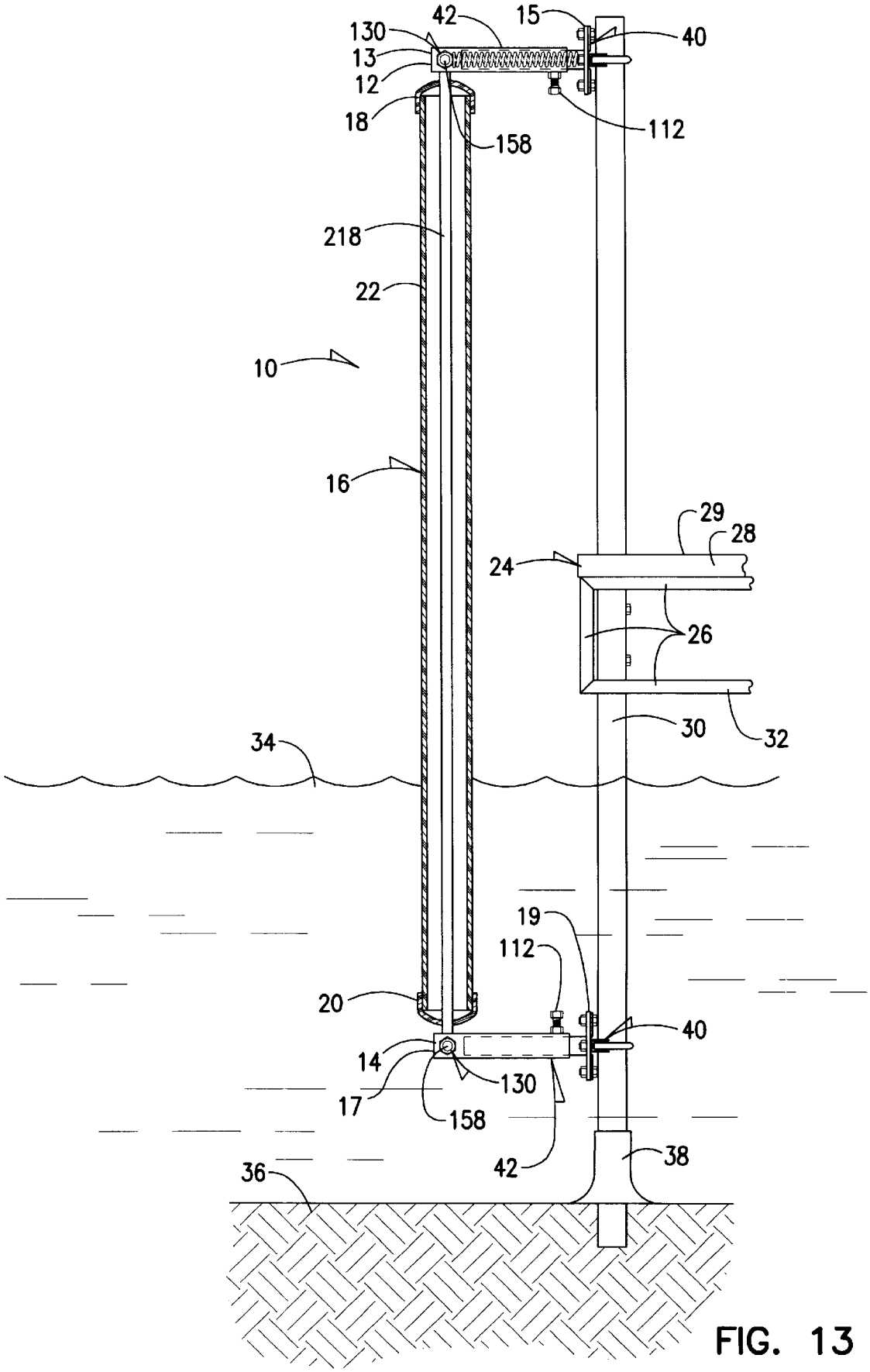
FIG. 13 is a schematic view of one embodiment of a watercraft docking system of the present invention.

Referring now to FIG. 13 there is shown an alternative embodiment of the watercraft docking system 10 according to the present invention. The watercraft docking system 10 includes a first support member 12 and a second support member 14, where each support member, 12 and 14, include a mounting bracket 40, an arm 42 coupled to the mounting bracket 40, and a rod assembly, 44 or 130, attached to the arm 42. The first support member 12 includes a bias element positioned within the arm 42, while the second support member 14 has an adjustable length. The first support member 12 having a bias element and the second support member 14 having an adjustable length are as previously described.

Figure 14:
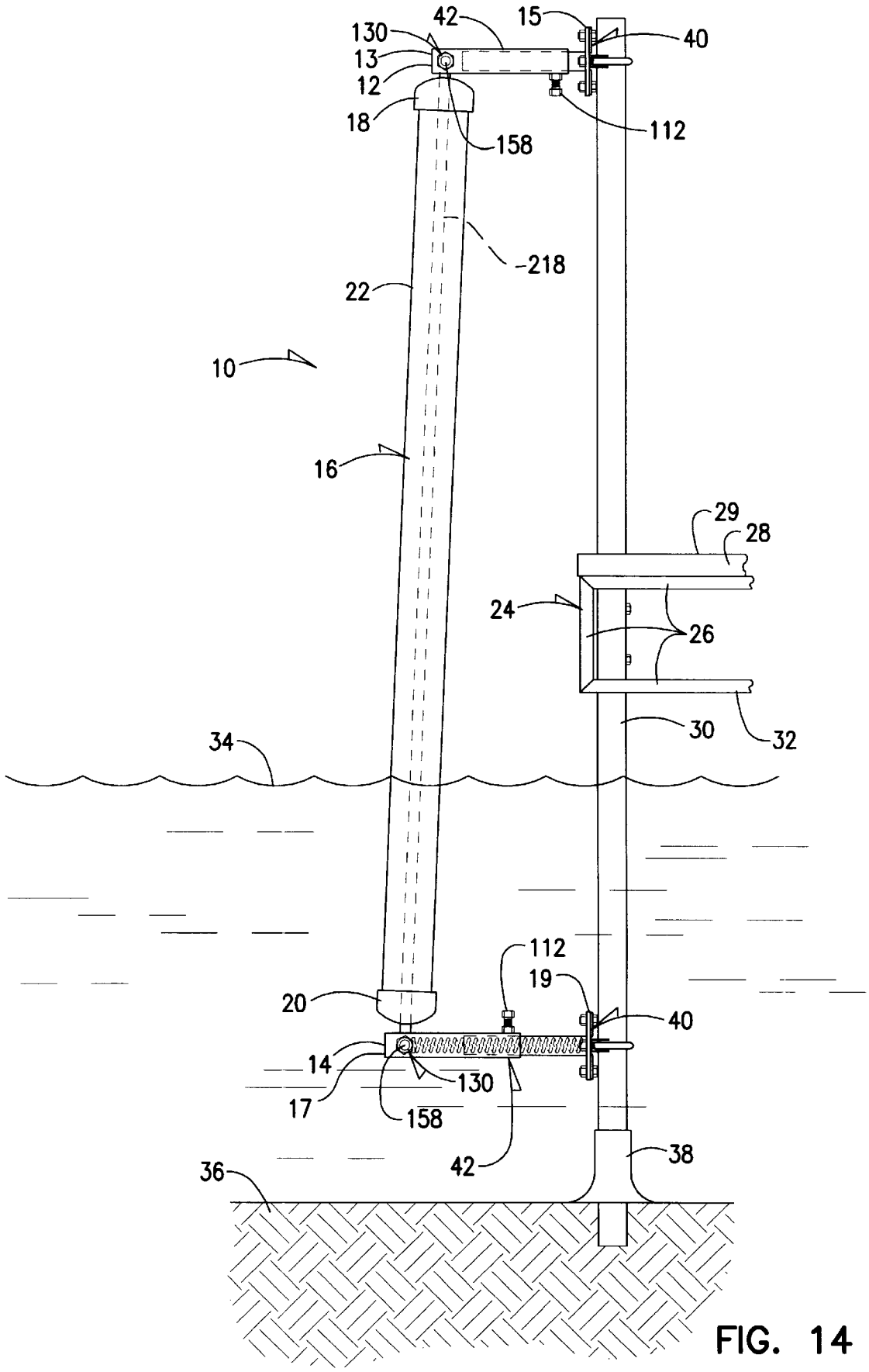
FIG. 14 is a schematic view of one embodiment of a watercraft docking system of the present invention.

Referring now to FIG. 14 there is shown an additional embodiment of the watercraft docking system 10 according to the present invention. The watercraft docking system 10 includes a first support member 12 and a second support member 14, where each support member, 12 and 14, include a mounting bracket 40, an arm 42 coupled to the mounting bracket 40, and a rod assembly, 44 or 130, attached to the arm 42. The first support member 12 includes the single elongated body 58 and the second support member 14 includes a bias element positioned within the arm 42. The first support member 12 having a single elongated arm and the second support member 14 having a bias element are as previously described.

In both FIGS. 13 and 14, the rod assembly, 44 or 130, has a shaft 218 which extends between the arm 42 of the first support member 12 and the second support member 14 to couple the first support member 12 to the elongated roller first end 18 and the second support member 14 to the elongated roller second end 20. The shaft 218 extends along the longitudinal axis of the elongated roller 16, and is cylindrical having threaded end portions. The threaded end portions are adapted to engage the threaded openings of the rod assembly, 44 or 130, as previously described.

The shaft 218 would first be positioned through the openings in the elongated roller first end 18 and the elongated roller second end 20. The threaded end portion is then secured within either the first support member 12 or the second support member 14. The remaining threaded end portion is then secured within the first support member 12 or the second support member 14, which ever is remaining. The threaded end portions of shaft 218 shown in FIG. 13 are secured within the arm 42 as previously described for FIGS. 5 and 11. The threaded end portions of shaft 218 shown in FIG. 14 are secured within the arm 42 as previously described for FIGS. 8 and 9.

Roller Frame

Figure 15:
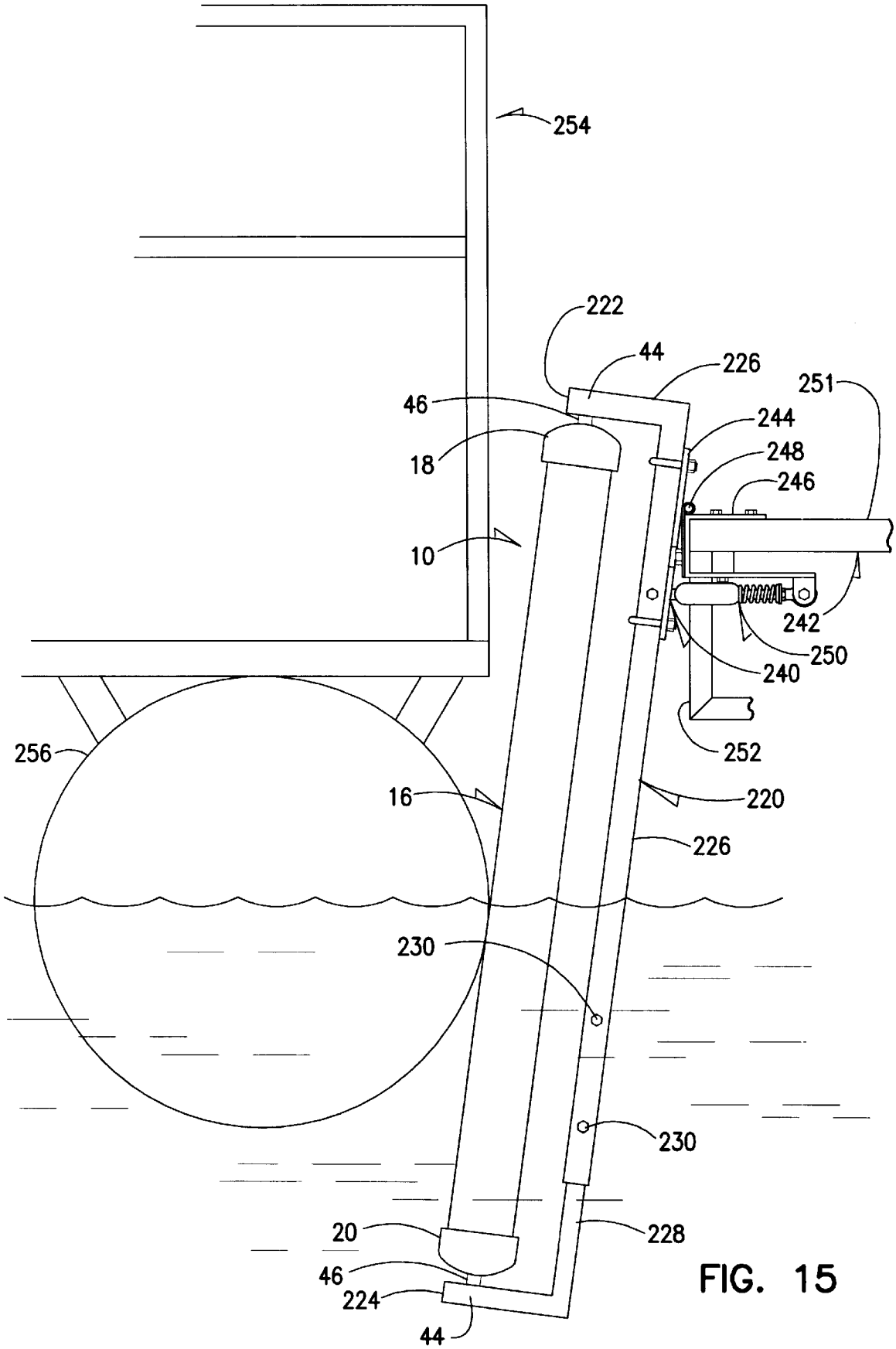
FIG. 15 is a schematic view of one embodiment of a watercraft docking system of the present invention.

Referring now to FIG. 15, there is shown an alternative embodiment of the watercraft docking system 10 according to the present invention. The watercraft docking system 10 comprises a roller frame 220 having a first retaining portion 222 and a second retaining portion 224, and an elongated roller 16 having a longitudinal axis, an elongated roller first end 18 and an elongated roller second end 20. The first retaining portion 222 is coupled to the elongated roller first end 18 and the second retaining portion 224 is coupled to the elongated roller second end 20 such that the elongated roller can rotate on its longitudinal axis.

The roller frame 220 includes a first portion 226 and a second portion 228. The first portion 226 has a tubular cross section which is of a shape and size adapted to receive a segment of the second portion 228. The segment of the second portion 228 is inserted into the first portion 226 a sufficient distance to allow retaining bolts 230 to secure together the first portion 226 and the second portion 228. In addition, the first retaining portion 222 and the second retaining portion 224 each include a rod assembly 44, where the rod assembly 44 includes a shaft 46 coupling the first retaining portion 222 to the elongated roller first end 18 and the second retaining portion 224 to the elongated roller second end 20.

The roller frame 220 includes a roller frame mounting assembly 240. The roller frame mounting assembly 240 is used with a dock 242, where the dock 242 has its structural supports located underneath the decking of the dock 242. The roller frame mounting assembly 240 includes a roller frame plate 244, a dock bracket 246, a hinge 248, and a spring unit 250. The roller frame 220 is secured to the roller frame plate 244, and the hinge 248 couples the roller frame plate 244 and the dock bracket 246 allowing the roller frame plate 244 to turn relative the dock bracket 246. The spring unit 250 is mounted between the roller frame plate 244 and the dock bracket 246 so that spring unit 250 resists the movement of the roller frame plate 244 when an object, such as a watercraft, come into contact with the elongated roller 16.

The dock bracket 246 of the roller frame mounting assembly 240 is secured to the dock 242 to hold the elongated roller 16 at a predetermined distance from the dock 242. In addition, the angle of the elongated roller 16 relative to the dock 242 is adjustable to allow the watercraft docking system 10 to accommodate a variety of watercraft. For example, the embodiment of the watercraft docking system 10 shown in FIG. 15 is designed to accommodate a pontoon boat 254, where the pontoon portion 256 of the pontoon boat 254 is intended to contact the elongated roller 16.

Figure 18:
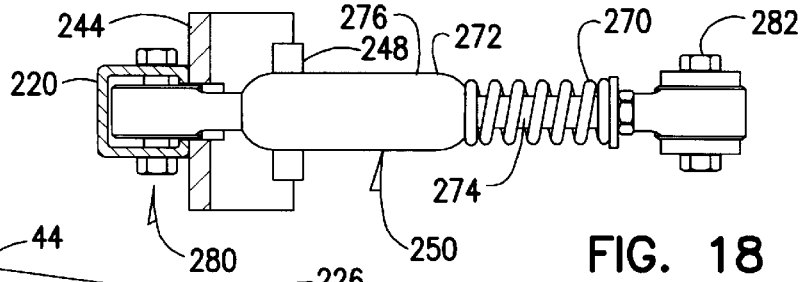
FIG. 18 is a schematic view of one embodiment of a spring unit according to the present invention.
Figure 16:
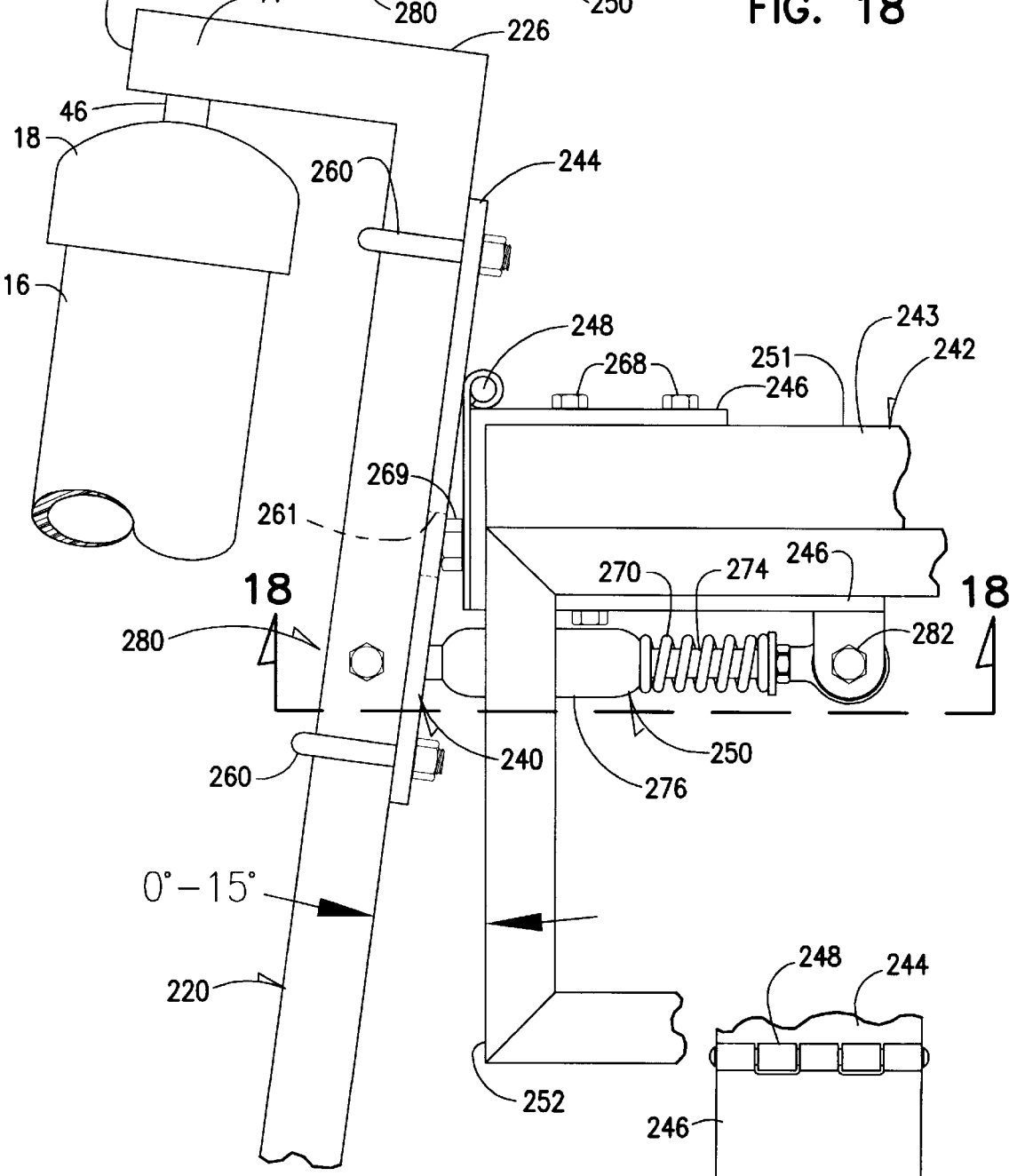
FIG. 16 is an enlarged schematic view of one embodiment of a watercraft docking system of the present invention as seen in FIG. 15.
Figure 17:
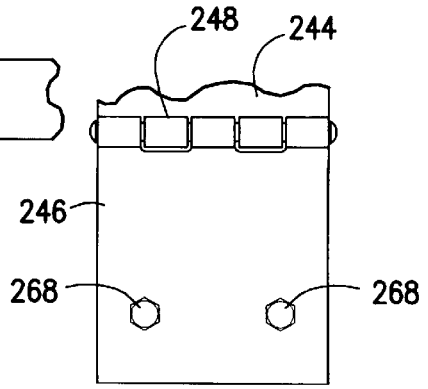
FIG. 17 is a schematic view of one embodiment of a dock bracket according to the present invention.

Referring now to FIGS. 16 to 18, there is shown an enlarged view of one embodiment of the roller frame mounting assembly 240. The roller frame plate 244 secures the roller frame 220 to the roller frame mounting assembly 240 through the use of U-bolts 260. In an alternative embodiment, the roller frame plate 244 secures the roller frame 220 to the roller frame mounting assembly 240 through straight bolts which are inserted through openings formed in the roller frame 220 and attached to the roller frame plate 244 with nuts. The roller frame mounting assembly 240 is secured to the dock 242 through the use of bolts 268 and bolt 269. The bolts 268 secure the dock bracket 246 to the dock 242 at a plurality of locations. In an additional embodiment, the roller frame plate 244 includes an opening 261 which is adapted to accommodate bolt 269 when force applied to the elongated roller 16 causes the roller frame plate 244 to pivot on the hinge 248 drawing the roller frame plate 244 to the dock bracket 246.

As force is applied to the elongated roller 16, the spring unit 250 provides a resistive force to the movement of the roller frame plate 244. The spring unit 250 acts like a shock absorber to dampen the force of a watercraft impacting the elongated roller 16. The spring unit 250 includes a coil spring 270 and a shock absorber 272. The shock absorber 272 can be made of any shock absorbing material, such as a resilient material. The shock absorber 272 includes a shaft 274 and a shock absorber body 276. The coil spring 270 is positioned over the shaft 274 of the shock absorber 272 and held in partial compression between the dock bracket 246 and the shock absorber body 276. The shaft 274 is secured to the dock bracket 246 with a first shock mounting bracket 280 and a second shock mounting bracket 282. The first shock mounting bracket 280 couples the shock absorber body 276 to the first portion 226 of the roller frame 220. A portion of the shock absorber body 276 extends through the roller frame plate 244 and into the body of the roller frame 220 first portion 226. A bolt is then placed through openings in the roller frame 220 first portion 226 and the shock absorber body 276 and a bolt used to secure the shock absorber body 276 to the roller frame 220.

The spring unit 250 is adapted to position the elongated roller 16 at an angle relative to a walking surface 251 of the dock 242. The angle of the elongated roller 16 is adjusted by selecting an appropriate shaft 274 length for the shock absorber 272, where a longer shaft 274 will create a greater elongated roller 16 angle as compared to a shorter shaft 274. The longitudinal axis of the elongated roller 16 is at an angle in the range of approximately a 90 to 105 degrees with respect to the walking surface 251 of the dock platform 243.

In the embodiment shown in FIG. 16, the roller frame mounting assembly 240 is shown as being added to or attached to a preexisting dock. However, the roller frame mounting assembly 240 or the elements of the roller frame mounting assembly 240 can be incorporated directly into the manufacture of a dock, such as dock 242. The roller frame 220 is constructed of metal, such as steel, galvanized steel, stainless steel or aluminum.

Figure 19:
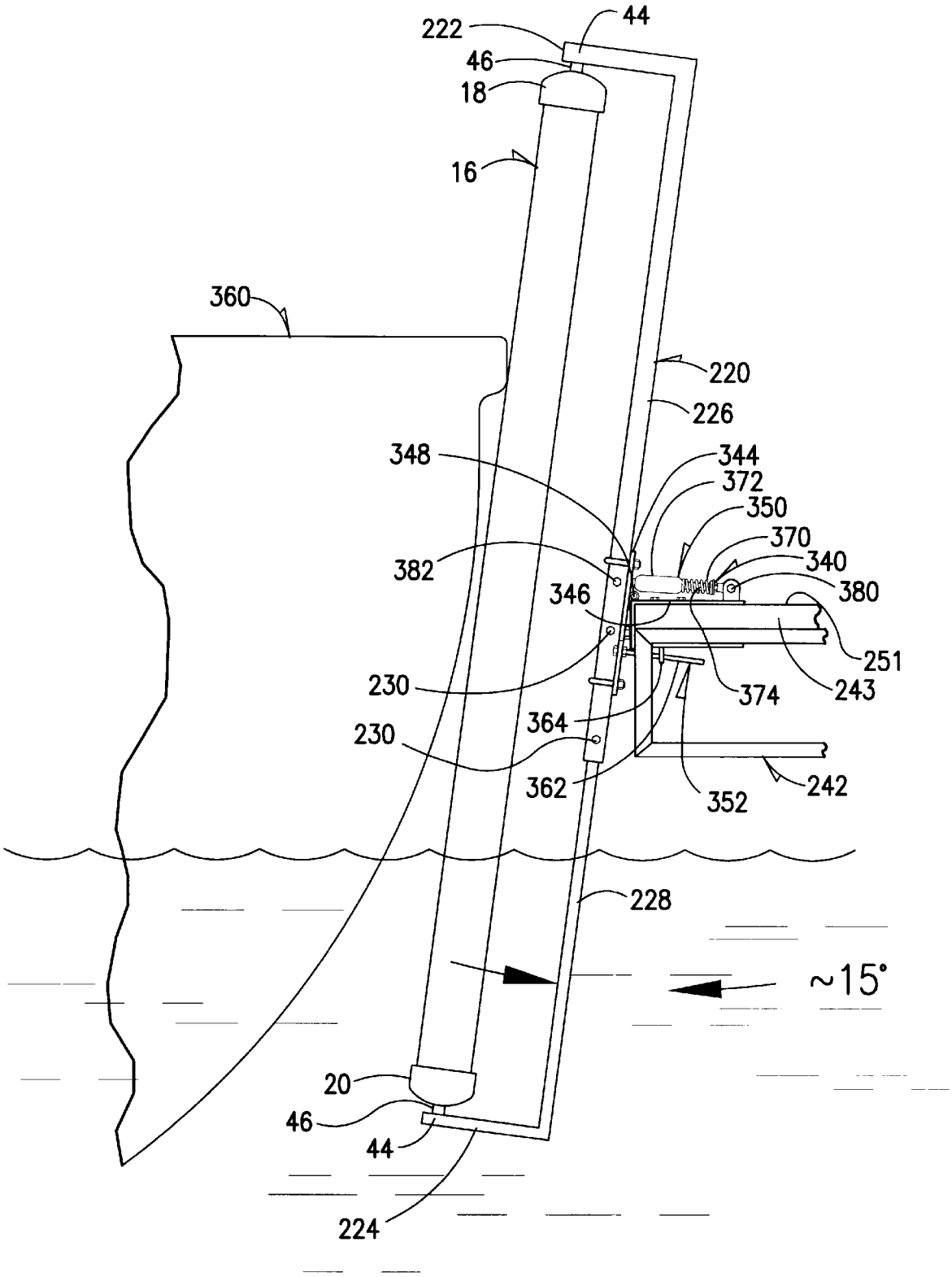
FIG. 19 is a schematic view of one embodiment of a watercraft docking system of the present invention.

Referring now to FIG. 19 there is shown an additional embodiment of the watercraft docking system 10 according to the present invention. The watercraft docking system 10 comprises a roller frame 220 having a first retaining portion 222 and a second retailing portion 224, and an elongated roller 16 having a longitudinal axis, an elongated roller first end 18 and an elongated roller second end 20. The first retaining portion 222 is coupled to the elongated roller first end 18 and the second retaining portion 224 is coupled to the elongated roller second end 20 such that the elongated roller 16 can rotate about the longitudinal axis.

The roller frame 220 includes a first portion 226 and a second portion 228. The first portion 226 has a tubular cross section which is of a shape and size adapted to receive a segment of the second portion 228 secured together with retaining bolts 230. The First retaining portion 222 and the second retaining portion 224 each include a rod assembly 44, where the rod assembly 44 has a shaft 46 coupling the first retaining portion 222 to the elongated roller first end 18 and the second retaining portion 224 to the elongated roller second end 20.

The roller frame 220 further includes a roller frame mounting assembly 340. Roller frame mounting assembly 340 is used with a dock 242, where the dock 242 has its structural supports located underneath the decking of the dock 242. The roller frame mounting assembly 340 includes a roller frame plate 344, a dock bracket 346, a hinge 348, a spring unit 350, and a pivot guide 352. The roller frame 220 is secured to the roller frame plate 344, and the hinge 348 couples the roller frame plate 344 and the dock bracket 346 allowing the roller frame plate 344 to pivot relative to the dock bracket 346.

The pivot guide 352 is coupled to the roller frame plate 344. The pivot guide 352 includes an elongated shaft 362 and a shaft guide 364. The shaft guide 364 includes an opening that is adapted to receive and guide the elongated shaft 362. The shaft guide 364 is mounted to the dock bracket 346. The elongated shaft 362 is inserted through the opening of the shaft guide 364. The elongated shaft 362 is then coupled to the roller frame plate 344. The elongated shaft 362 is coupled to the roller frame plate 344 by a hinged bracket (not shown) that allows the elongated shaft 362 to pivot relative the roller frame plate 344 so that the elongated shaft 362 move essentially parallel the dock platform 243 when the roller frame plate 344 pivots. The pivot guide 352 reduces the deflection of the roller frame plate 344 relative to the dock bracket 346 thereby reducing the torquing effect on the hinge 348 when a watercraft 360 contacts the elongated roller 16.

When watercraft 360 comes into contact with the elongated roller 16, the force of the watercraft 360 is exerted at a point above the roller frame mounting assembly 340. This force causes the elongated roller first end 18 to move towards the dock 242 as the roller frame 220 pivots on the hinge 348. As the elongated roller first end 18 pivots towards the dock 242, the elongated roller second end 20 pivots away from the dock 242. As this occurs, the spring unit 350 provides a resistive force to the movement of the roller frame plate 244. The spring unit 350 acts like a shock absorber to dampen the force of a watercraft impacting the elongated roller 16. The spring unit 350 includes a coil spring. 370 and a shock absorber 372. The shock absorber 372 includes a shaft 374 and a shock absorber body 376. The coil spring 370 is positioned over the shaft 374 of the shock absorber 372 and held in partial compression between the dock bracket 346 and the shock absorber body 376. The shaft 374 is secured to the dock bracket 346 with a first shock mounting bracket 380 and a second shock mounting bracket 382. The first shock mounting bracket 380 couples the shock absorber body 376 to the first portion 226 of the roller frame 220. The elongated shaft 362 of the pivot guide 352 also slides through the shaft guide 364, allowing the movement of the roller frame plate 344 relative to the dock bracket 346 to remain essentially in one plane of motion.

The spring unit 350 is adapted to position the elongated roller 16 at an angle relative to the dock 242. The angle of the elongated roller 16 is adjusted by selecting an appropriate shaft 374 length for the shock absorber 272, where a shorter shaft 374 will create a greater elongated roller 16 angle as compared to a longer shaft 374. The longitudinal axis of the elongated roller 16 is at an angle in the range of approximately a 90 to 105 degrees with respect to the walking surface 251 of the dock platform 243.

Figure 21:
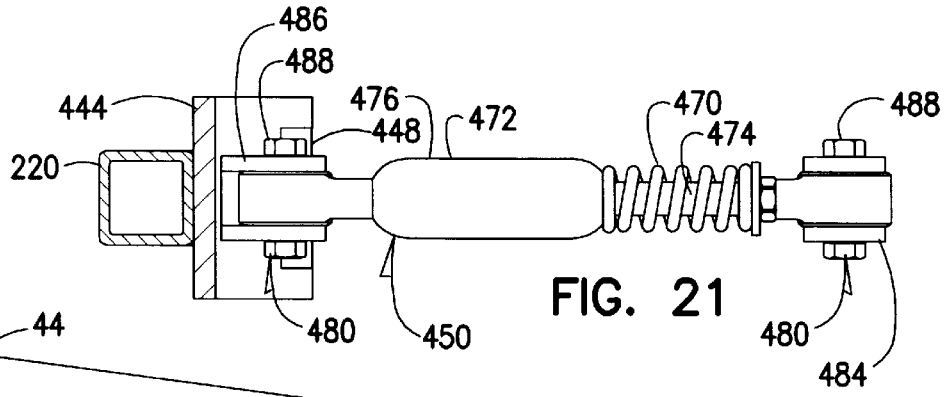
FIG. 21 is a schematic view of one embodiment of a spring unit according to the present invention.
Figure 20:
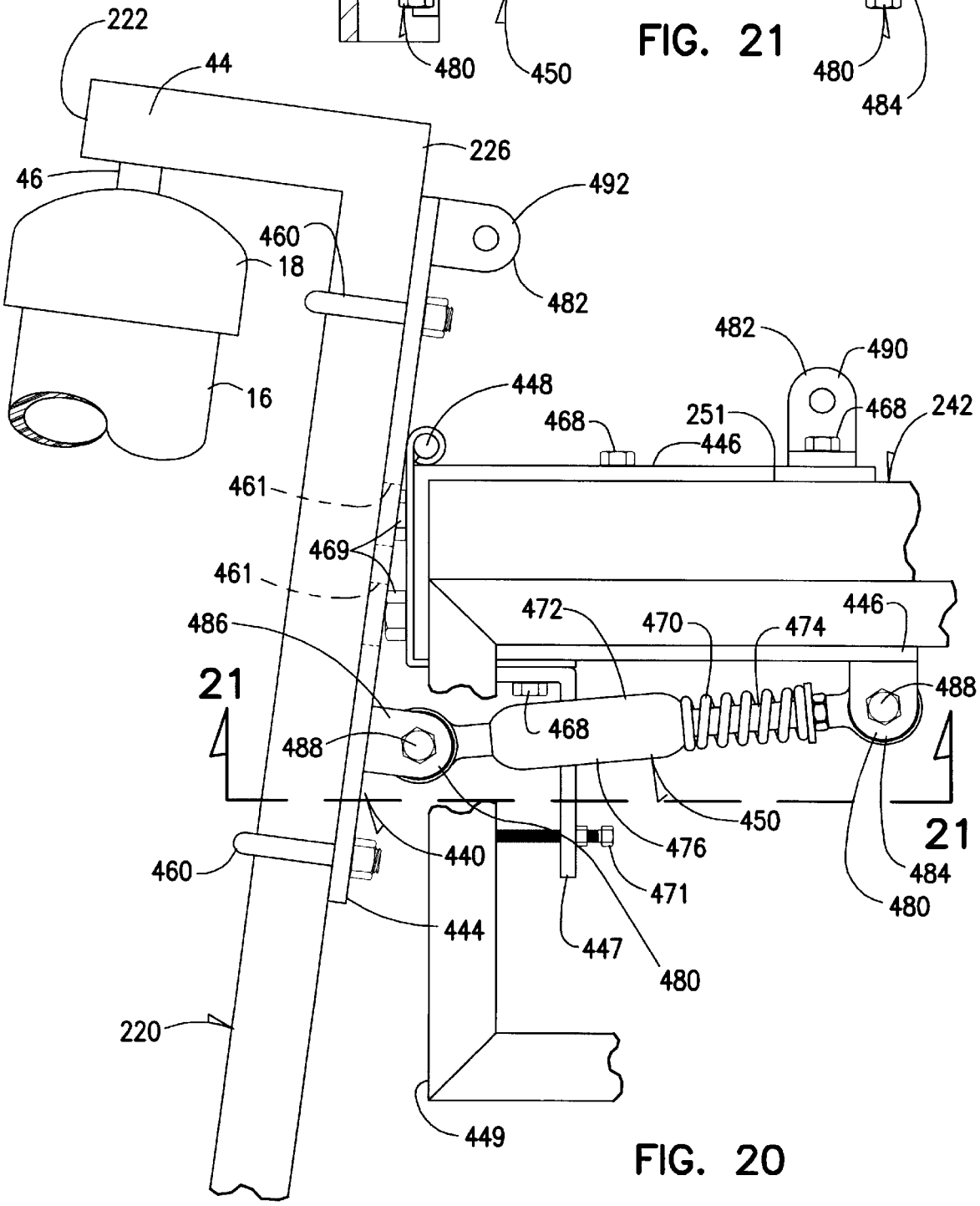
FIG. 20 is an enlarged schematic view of one embodiment of a watercraft docking system of the present invention.

Referring now to FIGS. 20 and 21 there is shown an additional embodiment of the watercraft docking system 10 according to the present invention. The watercraft docking system 10 comprises a roller frame 220 having a first retaining portion 222 and a second retaining portion 224, and an elongated roller 16 having a longitudinal axis, an elongated roller first end 18 and an elongated roller second end 20. The first retaining portion 222 is coupled to the elongated roller first end 18 and the second retaining portion 224 Is coupled to the elongated roller second end 20 such that the elongated roller 16 can rotate about the longitudinal axis.

FIG. 20 shows an enlarged view of a roller frame mounting assembly 440. The roller frame plate 444 secures the roller frame 220 to the roller frame mounting assembly 440 through the use of U-bolts 460. The roller frame mounting assembly 440 is secured to the dock 242 through the use of bolts 468, 469 and 471. The bolts 468 secure the dock bracket 446 to the dock 242 at a plurality of locations. In addition the roller frame plate 444 includes openings 461 which accommodate bolts 469 when the roller frame plate 444 pivots on the hinge 448 to draw the roller frame plate 444 to the dock bracket 446. The dock bracket 446 also includes a support structure 447 coupled between the underside of the dock 242 and a dock support rail 449. Bolts 468 and 471 are used to couple the support structure 447 to the dock bracket 446 and dock support rail 449, where bolt 471 is used to adjust the position of the dock bracket 446 relative the walking surface of the dock 242. The support structure 447 provides additional structural support for the dock bracket 446 and for the watercraft docking system 10 in general.

The roller frame plate 444 includes a first shock mounting bracket assembly 480 and a second shock mounting bracket assembly 482. The spring unit 450 can be attached to either the first shock mounting bracket assembly 480 or the second shock mounting bracket assembly 482. The location of the spring unit 450 depends upon the position of the roller frame 220 along the roller frame plate 444 relative to the walking surface 251 of the dock 242. The roller frame 220 is adjusted along the roller frame plate 444 by first loosening the U-bolts 460, adjusting the position of the roller frame relative the roller plate 444 and then resecuring the U-bolts 460. In the embodiment shown in FIG. 20, the roller frame 222 has been adjusted where the majority of the elongated roller 16 is positioned below the walking surface 251 of the dock 242. When the elongated roller 6 is in this position, the spring unit 450 is coupled to the first shock mounting bracket assembly 480.

As force is applied to the elongated roller 16, by a pontoon, or float, of a pontoon boat for example, the spring unit 450 provides a resistive force to the movement of the roller frame plate 444. The spring unit 450 acts like a shock absorber to dampen the force of a watercraft impacting the elongated roller 16. The spring unit 450 includes a coil spring 470 and a shock absorber 472. The shock absorber 472 includes a shaft 474 and a shock absorber body 476. The coil spring 470 is positioned over the shaft 474 of the shock absorber 472 and held in partial compression between the dock bracket 446 and the shock absorber body 476. The shaft 474 is secured to the dock bracket 446 with a first shock mounting bracket 484 and a second shock mounting bracket 486. The first shock mounting bracket 484 is coupled to the dock bracket 446 and the second shock mounting bracket 486 is coupled to the roller frame plate 444. The shock absorber 472 is then secured to the first shock mounting bracket 484 and the second shock mounting bracket 486 Through the use of bolt assembly 488.

The spring unit 450 is adapted to position the elongated roller 16 at an angle relative to a walking surface 251 of the dock 242. The angle of the elongated roller 16 is adjusted by selecting an appropriate shaft 474 length for the shock absorber 472, where a longer shaft 474 will create a greater elongated roller 16 angle as compared to a shorter shaft 474. The longitudinal axis of the elongated roller 16 is at an angle in the range of approximately a 90 to 105 degrees with respect to the walking surface 251 of the dock 242.

Alternatively, the roller frame 222 can also be adjusted to position the majority of the elongated roller 16 above the walking surface 251 of the dock 242. When the elongated roller 16 is in this position, the spring unit 450 is secured to the second shock mounting bracket assembly 482. When a watercraft having outboard bumpers or edges that are above the walking surface 251 of the dock 242 comes into contact with the elongated roller 16, the force of the watercraft is exerted at a point above the roller frame mounting assembly 440. This force causes the elongated roller first end 18 to move towards the dock 242 as the roller frame 444 pivots on the hinge 448. As the elongated roller first end 18 pivots towards the dock 242, the elongated roller second end 20 pivots away from the dock 242. As this occurs, the spring unit 450 provides a resistive force to the movement of the roller frame plate 444.

The spring unit 450 acts like a shock absorber to dampen the force of a watercraft impacting the elongated roller 16. The shaft 474 of the shock absorber 472 is secured to the dock bracket 446 with a third shock mounting bracket 490 and a fourth shock mounting bracket 492 through the use of bolt assembly 488. Additionally, the third shock mounting bracket 490 can be removed from the dock bracket 446 when the shock unit 450 is not located in the second shock mounting bracket assembly 482.

The spring unit 450 is adapted to position the elongated roller 16 at an angle relative to the dock 242. The angle of the elongated roller 16 is adjusted by selecting an appropriate shaft 474 length for the shock absorber 472, where a shorter shaft 474 will create a greater elongated roller 16 angle as compared to a longer shaft 474. The longitudinal axis of the elongated roller 16 is at an angle in the range of approximately a 90 to 105 degrees with respect to the walking surface 251 of the dock 242.

Spring Roller Frame

Figure 23:
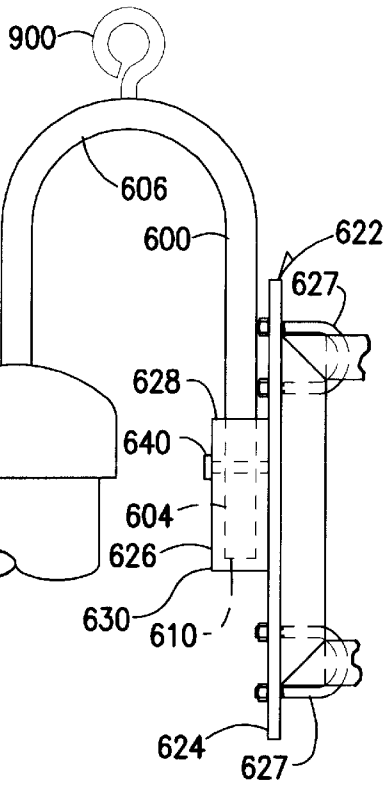
FIG. 23 is a schematic view of one embodiment of a roller frame support bracket of the present invention.
Figure 24:
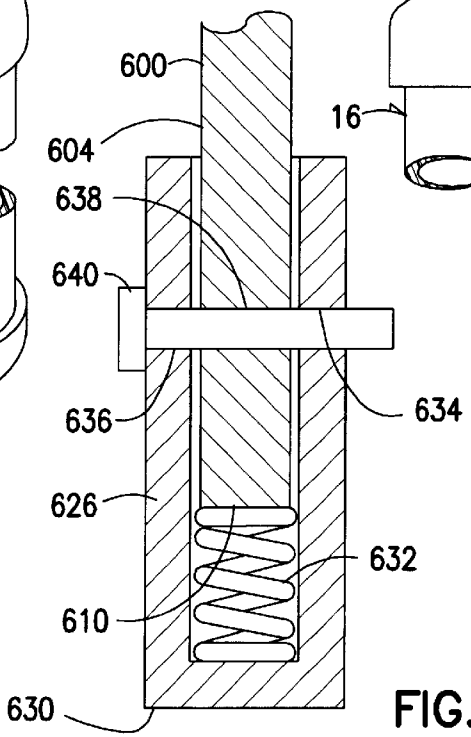
FIG. 24 is a cross sectional view of one embodiment of a roller frame support bracket of the present invention.
Figure 22:
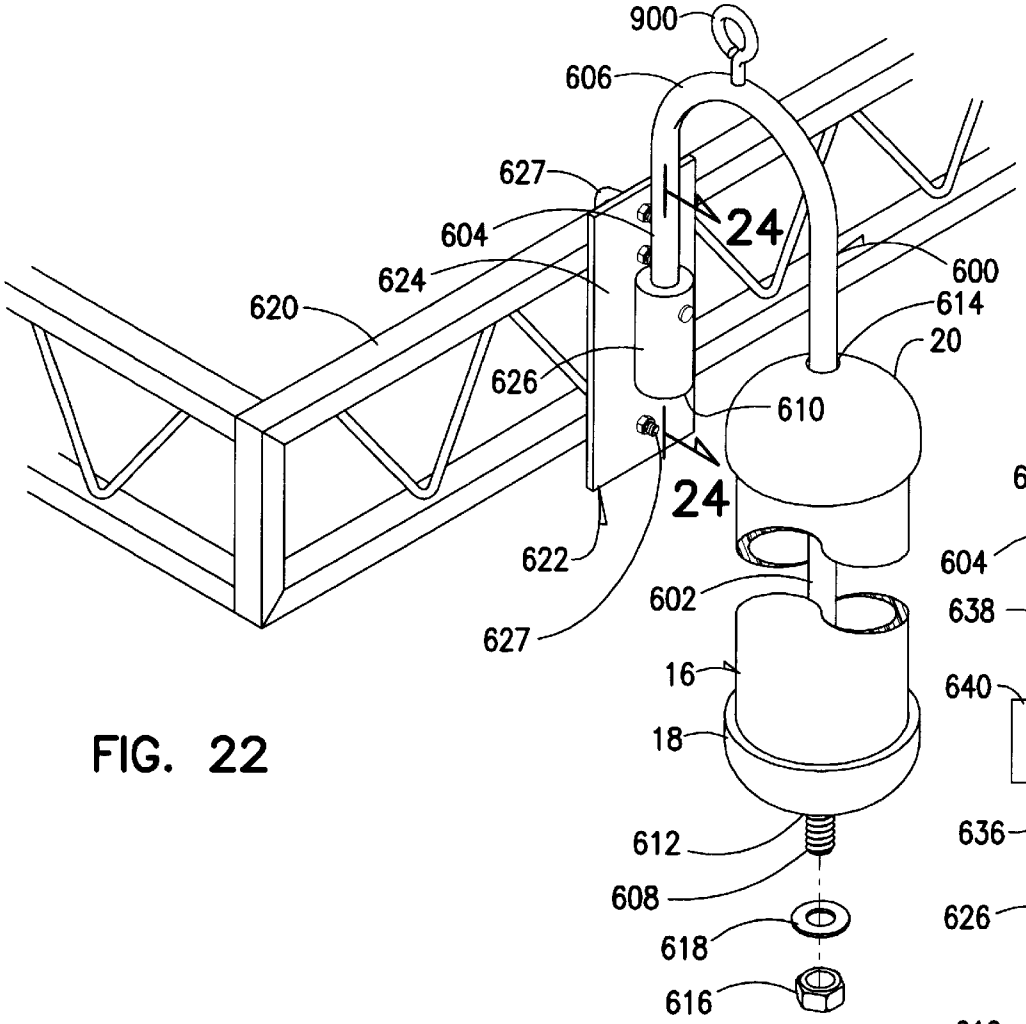
FIG. 22 is a schematic view of one embodiment of a watercraft docking system of the present invention.

Referring now to FIGS. 22 to 24 there is shown an additional embodiment of a watercraft docking system 10 according to the present invention. The watercraft docking system 10 includes a roller frame 600. The roller frame 600 is an elongated member having a first linear segment 602, a second linear segment 604, and a curved segment 606, where the curved segment 606 is located between the first linear segment 602 and the second linear segment 604. The roller frame 600 elongated structure also includes a first end 608 and a second end 610.

The elongated roller 16 is positioned over the first linear segment 602 by inserting the first liner segment 602 through the openings in the central portion of the elongated roller first end 18 and second end 20. The elongated roller 16 is then secured to the roller frame 600 at the first retaining portion 612 and the second retaining portion 614. The first retaining portion 612 is located at the first end 608 of the elongate structure of the roller frame 600. The second retaining portion 614 is located along the first linear segment 602, and is spaced between the first end 608 and the curved segment 606 of the roller frame 600.

The elongated roller 16 rests on the first retaining portion 612 and can rotate on its longitudinal axis at the first retaining portion 612 and the second retaining portion 614. The roller 16 merely rests on the first retaining portion 612 as shown in FIG. 22. Although not shown, the roller could be supported on the roller frame 600 using a one or more bearing sets. The bearing sets would have an inner race attached to the first liner segment 602 and an outer race attached to the roller 16. The roller 16 could be formed with the bearing sets therein or the bearing sets could be placed onto the first liner segment 602 and fixed into place with collars. The roller 16 could then be forced over the bearing set. An adhesive could be used to attach the bearing set to the inner diameter of the roller. As shown in FIG. 22, the first end 608 of the elongate structure of the roller frame 600 has a threaded surface that is adapted to receive nut 616. The nut 616 is used to secure the elongated roller 16 onto the first linear segment 602. In addition, a washer 618 is positioned between the elongated roller first end 18 and nut 616. As shown in FIG. 22, the roller frame 600 is provided with an eyebolt 900 along the curved portion 606. The eyebolt 900 is used to keep lines from a boat or other watercraft from becoming entangled with the frame 600.

FIGS. 22 and 23 show a perspective and side view of one embodiment of the roller frame 600 along with the elongated roller 16. The roller frame 600 is releasably attached to a dock 620 through the use of a roller frame support bracket 622. The roller frame support bracket 622 is secured to the dock 620 and is adapted to receive at least a portion of the second linear segment 604 of the roller frame 600.

One example of the roller frame support bracket 622 includes a support plate 624 and a support housing 626. The support plate 624 includes through openings adapted to receive U-bolts 627. The U-bolts 627 are used to secured the roller frame support bracket 622 to a dock 620. Alternatively, the roller frame support bracket 622 can be secured to the dock 620 in any number of ways including, but not limited to, using straight bolts, hanging the roller frame support bracket 622 on the dock 620 through the use of support projections extending from either the roller frame support bracket 622 or the dock 620 which are adapted to be inserted into corresponding openings provided in either the roller frame support bracket 622 or the dock 620.

The support housing 626 is coupled to the support plate 624 and is adapted to receive the second linear segment 604. One embodiment of the support housing is shown in FIG. 24, which shows a portion of an enlarged cross sectional view of the support housing 626. The support housing 626 is a socket having a tubular structure with a first end 628 and a second end 630 and being adapted to receive the second end 610 and a portion of the second linear segment 604 of the roller frame 600. A coil spring 632 rest against the inside surface of the support housing 626 at the second end 630 of the socket. As the second end 610 and the second linear segment 604 of the roller frame 600 is positioned within the support housing 626, the coil spring 632 prevents the second end 610 of the roller frame 600 from coming into direct contact with the second end 630 of the support housing 626.

In addition, the support housing 626 includes a first locking pin opening 634 and a second locking pin opening 636. The first locking pin opening 634 and the second locking pin opening 636 are located adjacent the second end 630 of the support housing 626 and are aligned on opposite sides of the support housing 626. The elongated structure of the roller frame 600 also includes a locking pin through opening 638 in the second linear segment 604. The first locking pin opening 634 and the second locking pin opening 636 of the support housing and the locking pin through opening 638 of the roller frame 600 are adapted to receive a locking pin 640.

The locking pin 640 is used to secure the roller frame 600 in the roller frame support bracket 622. The second linear segment 604 of the roller frame 600 is inserted into the support housing 626 until the second end 610 come into contact with the coil spring 632. Pressure is then applied to the roller frame 600, which causes the second end 610 to press against and partially compress the coil spring 632. As the coil spring 632 is being compressed, the locking pin through opening 638 and the locking pin openings, 634 and 636, aline. The locking pin 640 is then inserted through the aligned openings to secure the roller frame 600 to the support housing 626 and the dock 620.

The curved segment 606 of the roller frame 600 holds the elongated roller 16 at a predetermined distance from the roller frame support bracket 622 and from the dock 620. As a watercraft comes into contact with the elongated roller 16, the curved segment 606 resiliently flexes to absorb the force of the watercraft. In this way, the curved segment 606 acts like a spring to prevent the elongated roller 16, and the watercraft, from contacting the edge of the dock 620.

The elongate member of the roller frame 600 is constructed of metal, such as steel, stainless steel, spring steel or other resilient metal as is known in the art. In one embodiment, the roller frame 600 is constructed of a rod of resilient spring steel rod, where the rod has a diameter in the range of approximately 1 to 3 centimeters. Additionally, the position of the elongated roller 16 is adjusted by selecting different lengths of elongated member of the roller frame 600. For example, the angle of the elongated roller 16 relative to the walking surface of the dock 620 can be adjusted by changes in the radius of curvature in the curved portion 606 of the roller frame 600. Additionally, the vertical position of the elongated roller 16 relative to the to walking surface of the dock 620 can be adjusted by changing the length of the second linear segment 604.

In an additional embodiment, the roller frame 600 can be releasably secured directly into the support structure of a dock. In this embodiment, one or more support housings, such as the support housing 626, are integrated directly into the support structure of the dock 620. The openings of the support housings are set flush with the walking surface of the dock and are positioned at predetermined intervals around the periphery of the dock's walking surface. In this way, one or more roller frames 600 can be positioned in any number of locations and combinations around the dock.

Additionally, the roller frame 600 can be secured to the dock in such a way that the second linear segment 604 instead of extending up towards the walking surface of the dock 620 (as shown in FIG. 22), extends down away from the walking surface of the dock 620. The curved segment 606 then curves away from the dock and the first linear segment 602 supports the elongated roller 16 at a predetermined distance from the dock 620. In this embodiment, the first linear segment 602 is provided with a means of supporting the elongated roller 16 at the second retaining portion 614 such that the elongated roller 16 can rotate on its longitudinal axis. In one embodiment, a collar extending from the surface of the roller frame elongate structure is used as the means of supporting the elongated roller 16.

Figure 25:
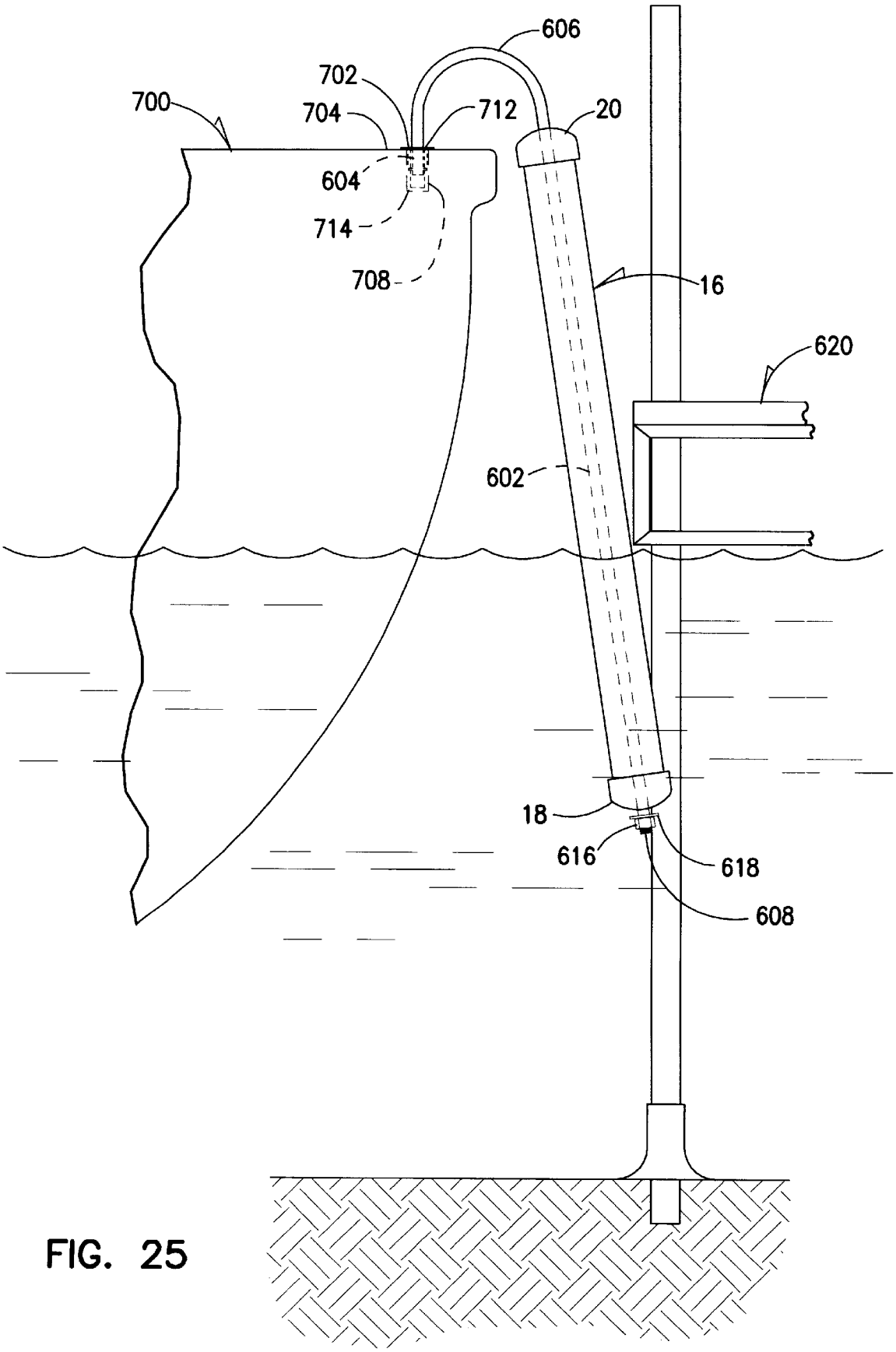
FIG. 25 is a schematic view of one embodiment of a watercraft docking system of the present invention.
Figure 26:
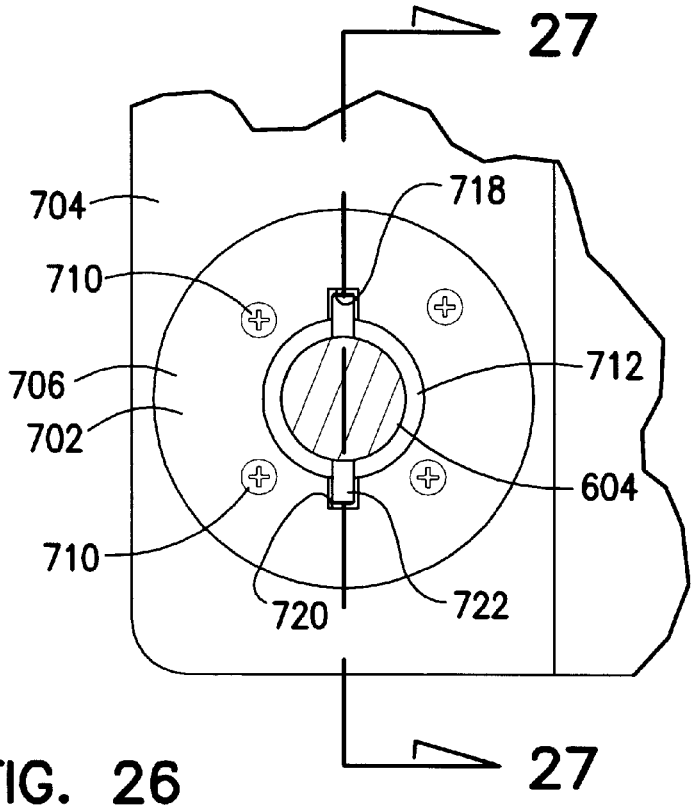
FIG. 26 is a schematic view of one embodiment of a roller frame support bracket of the present invention.
Figure 27:
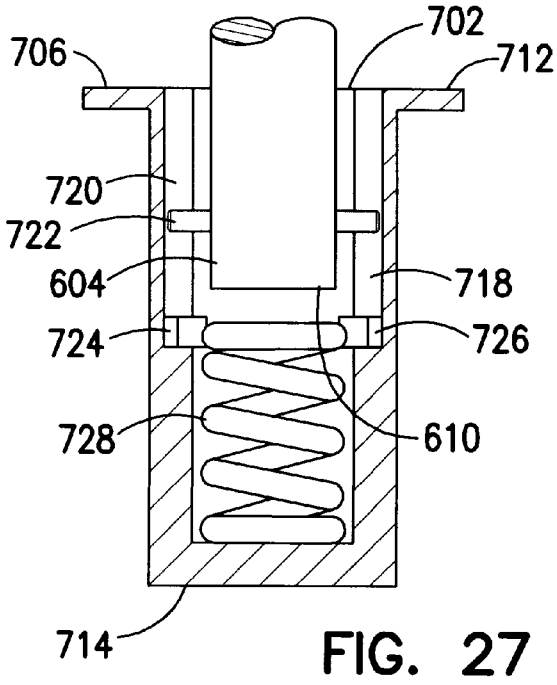
FIG. 27 is a cross sectional view of one embodiment of a roller frame support bracket of the present invention.

Referring now to FIGS. 25 to 27 there is shown an additional embodiment of the watercraft docking system 10 of the present invention. FIG. 25 perspective view of one embodiment where the roller frame 600 is releasably incorporated onto a boat 700. The boat 700 includes an additional embodiment of a roller frame support bracket 702, which is adapted to be mounted to or incorporated into the boat 700 and to receive at least a portion of the second linear segment 604 of the roller frame 600. The boat 700 can include one or more of the roller frame support bracket 702 mounted on either its hull, deck or flooring structures.

FIG. 25 and 26 show the roller frame support bracket 702 mounted to and incorporated into an upper edge portion 704 of the boat 700. One example of the roller frame support bracket 702 includes a support plate 706 and a support housing 708, where the support housing 708 is incorporated into the support plate 706. The support plate 706 includes through openings adapted to receive mounting screws 710. The mounting screws 710 are used to secured the roller frame support bracket 702 to the upper edge portion 704 of the boat 700.

FIG. 27 shows a portion of an enlarged cross sectional view of the roller frame support bracket 702. The support housing 708 is a socket having a tubular structure with a first end 712 and a second end 714, and is adapted to receive the second end 610 and a portion of the second linear segment 604 of the roller frame 600. The inner walls of the support housing 708 socket have surfaces defining a first channel 718 and second channel 720. The first channel 718 and the second channel 720 are aligned on opposite sides of the support housing 708 socket.

The first channel 718 and the second channel 720 are adapted to receive a retaining pin 722, where the retaining pin 722 is coupled to the second linear segment, 604 of the roller frame 600. The retaining pin 722 is secured in a centrally located through opening in the second linear segment 604, and is positioned such that the retaining pin 722 extends equal distances away from the surface on either side of the second linear segment 604. The inner wall of the support housing 708 socket also includes surfaces defining a first docking channel 724 and a second docking channel 726. The first docking channel 724 and the second docking channel 726 are located on opposite sides of the inner wall of the support housing 708 and are adapted to receive the portions of the retaining pin 722 extending from the surface of the second linear segment 604. The first docking channel 724 and the second docking channel 726 further include a notched portion at relatively the same distance along the docking channel, where the notched portion extend upward from the docking channel towards the first opening 712. The notched portions are approximately the shape and size of the retaining pin 722 and are adapted to receive the retaining pin 722 portion extending from the surface of the second linear segment 604.

The support housing 708 further includes a coil spring 728 which rest against the inside surface of the support housing 708 at the second end 714 of the socket. In securing the roller frame 600 to the boat 700, the second end 610 of the roller frame 600 is inserted into the first end 712 of the support housing 708. As the second linear portion 604 is inserted into the support housing 708 the portions of the retaining pin 722 extending from the surface of the second linear portion 604 are aligned with the first docking channel 724 and the second docking channel 726.

As the second linear portion 604 continues to be inserted into the support housing 708, the second end 610 of the roller frame 600 contacts the coil spring 728. Pressure is then applied to the roller frame 600, which causes the second end 610 to press against and partially compress the coil spring 728. As the coil spring 728 is being compressed, the portions of the retaining pin 722 extending from the surface of the second linear portion 604 aline with the first docking channel 724 and the second docking channel 726. The roller frame 600 is then rotated so that the portions of the retaining pin 722 extending from the surface of the second linear portion 604 travel through the first docking channel 724 and the second docking channel 726 until the retaining pin portions come to the end of the docking channels. At this point, the curved segment 606 of the roller frame extends away from the boat at an essentially perpendicular angle, causing the roller frame support bracket 702 to hold the elongated roller 16 at a predetermined distance from the roller frame support bracket 702. Pressure on the roller frame 600 is then released and the coil spring 724 urges the roller frame 600 upward toward the first opening 712, thereby seating the retaining pin portions in the notched portions of the first docking channel 724 and the second docking channel 726.

Once the retaining pin portions have seated into the notched portions of the first docking channel 724 and the second docking channel 726, the roller frame 600 serves to protect the boat 700 as it is being docked or as it come along side another boat. As a elongated roller 16 coupled to the boat 700 comes into contact with a structure, such as a dock, the curved segment 606 resiliently flexes to absorb the force of the impact. In this way, the curved segment 606 acts like a spring to prevent the elongated roller 16, and the boat, from contacting the structure.

Figure 28:
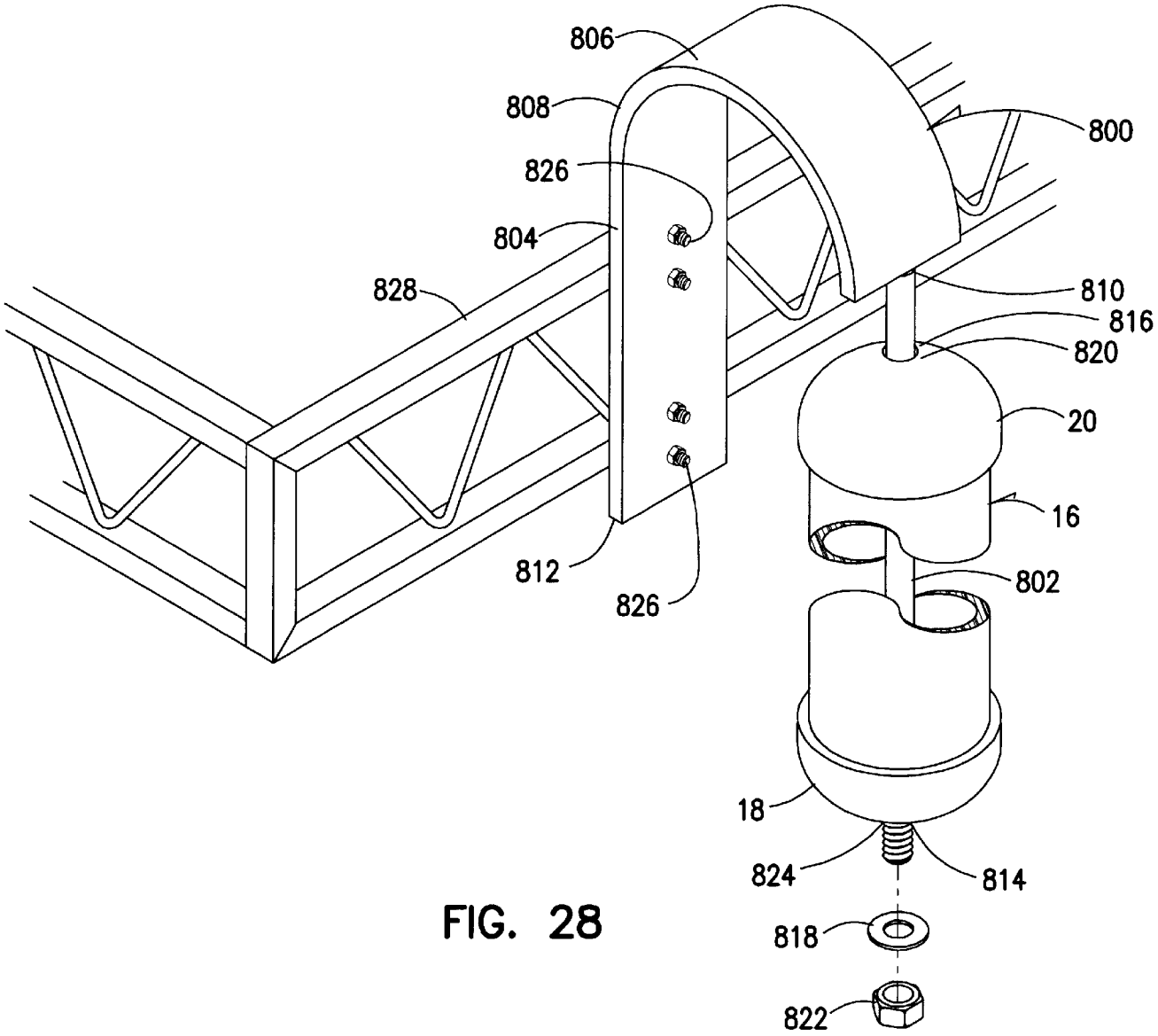
FIG. 28 is a schematic view of one embodiment of a watercraft docking system of the present invention.

Referring now to FIG. 28 there is shown an additional embodiment of a watercraft docking system 10 according to the present invention. The watercraft docking system 10 includes a roller frame 800. The roller frame 800 has a first linear segment 802, a second linear segment 804, and a curved segment 806, where the curved segment 806 is located between the first linear segment 802 and the second linear segment 804.

The second linear segment 804 and the curved segment 806 form a roller frame support bracket 808, where the roller frame support bracket 808 has a first end 810 and a second end 812. The first linear segment 802 has a first end 814 and a second end 816, where the second end 816 of the first linear segment 802 is coupled to the first end 810 of the roller frame support bracket 808. As shown in FIG. 28, the roller frame support bracket 808 has rectangular parallelopiped shape or construction. Additionally, the first linear segment 802 has an elongated cylindrical shape, where the second end 816 of the first linear segment 802 is welded to the first end 810 of the roller frame support bracket 808. Alternatively, the second end 816 includes threads on the surface of the first linear segment 802 which are adapted to be secured into a tapped opening in the first end 810 of the roller frame support bracket 808.

The elongated roller 16 is positioned over the first linear segment 802 by inserting the first liner segment 802 through the openings in the central portion of the elongated roller first end 18 and second end 20. The elongated roller 16 is then secured to the roller frame 800 at a first retaining portion 818 and the second retaining portion 820. The first retaining portion 818 is located at a first end 814 of the first linear portion 802 of the roller frame 800. The second retaining portion 820 is located at a second end 816 of the first linear portion 802 of the roller frame 800.

The elongated roller 16 rests on the first retaining portion 818 and can rotate on its longitudinal axis at the first retaining portion 818 and the second retaining portion 820. The first end 814 of the roller frame 800 has a threaded surface that is adapted to receive nut 822. The nut 822 is used to secure the elongated roller 16 onto the first linear segment 802. In addition, a washer 824 is positioned between the elongated roller first end 18 and nut 822.

The second linear segment 804 of the roller frame support bracket 808 includes through openings adapted to receive U-bolts 826. The U-bolts 828 are used to secured the second linear segment 804, and the roller frame 800, to a dock 828. Alternatively, the roller frame 800 can be secured to the dock 828 in any number of ways including, but not limited to, using straight bolts, hanging the second linear segment 804 on the dock 828 through the use of support projections extending from either the second linear segment 804 or the dock 828 which are adapted to be inserted into corresponding openings provided in either the second linear segment 804 or the dock 828.

The curved segment 806 of the roller frame 800 holds the elongated roller 16 at a predetermined distance from the roller frame support bracket 808 and from the dock 828. As a watercraft comes into contact with the elongated roller 16, the curved segment 806 resiliently flexes to absorb the force of the watercraft. In this way, the curved segment 806 acts like a spring to prevent the elongated roller 16, and the watercraft, from contacting the edge of the dock 828.

The roller frame support bracket 808 and the first linear segment 802 of the roller frame 800 are constructed of metal, such as steel, stainless steel, spring steel, aluminum or other resilient metal as is known in the art. In one embodiment, the roller frame support bracket 808 is constructed of a rectangular parallelopiped segment of resilient spring steel, where the rectangular parallelopiped segment has a width in the range of approximately 3 to 16 centimeters and the thickness is in the range of approximately 1 to 3 centimeters. Additionally, the first linear segment 802 of the roller frame 800 is constructed of a cylindrical rod, where the rod has a diameter in the range of approximately 1 to 3 centimeters.

Additionally, the position of the elongated roller 16 is adjusted by selecting different lengths of elongated member of the roller frame 800. For example, the angle of the elongated roller 16 relative to the walking surface of the dock 828 can be adjusted by changes in the radius of curvature of the curved portion 806 of the roller frame 800. Additionally, the vertical position of the elongated roller 16 relative to the to walking surface of the dock 620 can be adjusted by changing the length of the second linear segment 804.

The present invention has been described with reference to the accompanying figures. It will be apparent to those skilled in the art that changes and modifications can be made to the embodiments described without departing from the scope of the present invention. For example, it is possible for a watercraft docking system 10 to have for the first support member 12 and the second support member 14 any combination of single body arm 42, adjustable arm 42 and arms 42 including bias members. The watercraft docking system 10 can be mounted to position the longitudinal axis of the elongated roller essentially parallel, or horizontal, to the walking surface of the dock platform. Also, the dock bracket could be integrated into the dock and/or secured to the dock so that the dock bracket does not extend above the walking surface of the dock. In addition, it is possible for the first and second retaining portions, 222 and 224, of the roller frame 220 to be adapted to further include bias members as described above.

What is claimed is:

1. A watercraft docking system, comprising:

a first support member having a proximal and distal ends;

a second support member having proximal and distal ends;

an elongated roller having a longitudinal axis, an elongated roller first end and an elongated roller second end, the distal end of the first support member being coupled to the elongated roller first end and the distal end of the second support member being coupled to the elongated roller second end to allow the elongated roller to rotate on the longitudinal axis, said elongated roller adapted for placement into water; and a spring unit mounted to one of the first support member or the second support member, the elongated roller rotatable with respect to the first support member, the second support member, and the attached spring unit.

2. The watercraft docking system of claim 1, further comprising a dock which includes a support structure; and a dock platform having a walking surface, the proximal end of the first and second support members being secured to the support structure to hold the elongated roller at a predetermined distance from the dock.

3. The watercraft docking system of claim 2, where the support structure includes a pole positioned essentially perpendicular to the walking surface of the dock platform and the proximal ends of the first and second support members are secured in a spaced relationship along the pole.

4. The watercraft docking system of claim 3, where the longitudinal axis of the elongated roller is at an angle with respect to the axis of the pole.

5. The watercraft docking system of claim 1, where the first support member and the second support member each include a mounting bracket at the proximal end;

an arm coupled to the mounting bracket; and a rod assembly attached to the arm at the distal end, the rod assembly of the first support member having a shaft extending from the arm of the first support member to couple the first support member to the elongated roller first end, and the rod assembly of the second support member having a shaft extending from the arm of the second support member to couple the second support member to the elongated roller second end.

6. The watercraft docking system of claim 5, where the arm includes a tubular arm portion and a receiving arm portion having first and second ends and a central opening, the first end of the receiving arm portion first end being secured to the mounting bracket, the second end of the tubular arm portion supporting the shaft and at least a portion of the receiving arm portion being slidably received in the central opening to allow the length of the arm to be adjusted.

7. The watercraft docking system of claim 6, where the tubular arm portion has at least one through opening adapted to receive a retaining element, and the length of the arm is fixed by releasably engaging the retaining element between the tubular arm portion and the receiving arm portion.

8. The watercraft docking system of claim 1, where the first support member and the second support member each include a mounting bracket at the proximal end, an arm coupled to the mounting bracket, and a rod assembly attached to the arm at the distal end, the rod assembly having a shaft extending between the arm of the first support member and the second support member to couple the first support member to the elongated roller first end and the second support member to the, elongated roller second end.

9. A watercraft docking system, comprising:

a first support member having a proximal and distal ends;

a second support member having proximal and distal ends; and an elongated roller having a longitudinal axis, an elongated roller first end and an elongated roller second end, the distal end of the first support member being coupled to the elongated roller first end and the distal end of the second support member being coupled to the elongated roller second end to allow the elongated roller to rotate on the longitudinal axis, where the first support member and the second support member each include a mounting bracket at the proximal end;

an arm coupled to the mounting bracket; and a rod assembly attached to the arm at the distal end, the rod assembly of the first support member having a shaft extending from the arm of the first support member to couple the first support member to the elongated roller first end, and the rod assembly of the second support member having a shaft extending from the arm of the second support member to couple the second support member to the elongated roller second end, where the arm includes a tubular arm portion and a receiving arm portion having first and second ends and a central opening, the first end of the receiving arm portion first end being secured to the mounting bracket, the second end of the tubular arm portion supporting the shaft and at least a portion of the receiving arm portion being slidably received in the central opening to allow the length of the arm to be adjusted, the arm further including a bias element positioned within the tubular arm portion between the receiving arm portion and the tubular arm portion, and the receiving arm portion having a retaining ridge extending from a receiving arm exterior surface and a retaining element on the tubular arm portion, the tubular arm portion and receiving arm portion being relatively movable between a first position to which the tubular arm portion and the receiving arm portion are biased by the bias element with the retaining element and the retaining ridge engaged, and a second position with the retaining ridge and the retaining element spaced apart and a longer portion of the receiving arm portion being received in the central opening than in the first position.

10. The watercraft docking system of claim 9, where the bias element is a coil spring.

11. The watercraft docking system of claim 9, where the receiving arm portion is a coil spring.

12. The watercraft docking system of claim 9, where the receiving arm portion comprises a solid flexibly resilient polymer.

13. A watercraft docking system, comprising:

a roller frame having a first retaining portion and a second retaining portion; and an elongated roller having a longitudinal axis, an elongated roller first end and an elongated roller second end, the first retaining portion being coupled to the elongated roller first end and the second retaining portion being coupled to the elongated roller second end to allow the elongated roller to rotate on the longitudinal axis.

14. A watercraft docking system, comprising:

a roller frame having a first retaining portion and a second retaining portion;

an elongated roller having a longitudinal axis, an elongated roller first end and an elongated roller second end, the first retaining portion being coupled to the elongated roller first end and the second retaining portion being coupled to the elongated roller second end to allow the elongated roller to rotate on the longitudinal axis; and a roller frame mounting assembly having a roller frame plate;

a dock bracket;

a hinge; and a spring unit, where the roller frame is secured to the roller frame plate, the hinge couples the roller frame plate and the dock bracket allowing the roller frame plate to pivot relative the dock bracket, and the spring unit is mounted between the roller frame plate and the dock bracket so that spring unit resists the movement of the roller frame plate.

15. The watercraft docking system of claim 14, including a dock, where the dock bracket of the roller frame mounting assembly is secured to the dock to hold the elongated roller at a predetermined distance from the dock.

16. The watercraft docking system of claim 14, where the spring unit includes a coil spring and a shock absorber, the shock absorber having a shaft and a shock absorber body, and the coil spring being positioned over the shaft of the shock absorber and held in partial compression between the dock bracket and the shock absorber body.

17. The watercraft docking system of claim 15, where the dock includes a dock platform having a walking surface and the longitudinal axis of the elongated roller is at an angle with respect to the walking surface of the dock platform.

18. The watercraft docking system of claim 14, where the roller frame is an elongated member having a first linear segment, a second linear segment, and a curved segment between the first linear segment and the second linear segment, where the elongate roller is positioned over the first linear segment with the first retaining portion located at a first end of the roller frame, and the second retaining portion located along the first linear segment, and where a second end of the elongated member is positioned in a roller frame support bracket to hold the elongated roller at a predetermined distance from the roller frame support bracket.

19. A watercraft docking system, comprising:

a first support member having distal and proximal ends and a second support member having proximal and distal ends, where the first support member and the second support member each include a mounting bracket at the proximal end, an arm coupled to the mounting bracket, and a rod assembly attached to the arm at the distal end, the rod assembly of the first support member having a shaft extending from the first support member arm and the rod assembly of the second support member having a shaft extending from the second support member arm to couple the second support member to the elongated roller second end;

an elongated roller having a longitudinal axis, an elongated roller first end, an elongated roller second end and a length between approximately 80 to 155 centimeters, where the shaft of the first support member couples the first support member to the elongated roller first end and the shaft of the second support member couples the second support member to the elongated roller second end to allow the elongated roller to rotate on the longitudinal axis;

a spring unit; and a dock having a support structure and a dock platform having a walking surface, the proximal end of the first and second support members being secured to the support structure with the spring unit to hold the elongated roller at a predetermined distance from the dock, and where the longitudinal axis of the elongated roller is at an angle with respect to the walking surface of the dock platform.

20. A method of making a watercraft docking system, the method comprising the steps of:

coupling an elongated roller to a first support member and a second support member such that the elongated roller turns about its longitudinal axis when provided with sufficient rotational force; and securing the first support member and the second support member to a structure with a spring unit, said spring unit allowing the first retaining portion and a second retaining portion to rotate in a plane including and the longitudinal axis of the elongated roller; and adjusting the spring unit to adjust the angle at which the elongated roller enters the water.

* * * * *

UNITED STATES PATENT AND TRADEMARK OFFICE

CERTIFICATE OF CORRECTION

PATENT NO. : 6,112,690
DATED : September 5, 2000
INVENTOR(S) : Anderson

It is certified that error appears in the above-identified patent and that said Letters Patent is hereby corrected as shown below:

Column 1,
Line 22, delete "to" after "damage".

Column 3,
Line 33, delete ";" and insert -- : --,therefor.

Column 4,
Line 64, delete "an" and insert -- a --, therefor.

Column 5,
Line 41, delete "move" and insert -- moves --, therefor.

Column 6,
Lien 33, delete "openings" and insert -- opening --, therefor.

Column 7,
Line 6, delete "are" and insert -- is --, therefor.
Line 47, delete "arcuvet" and insert -- arcuate --, therefor.

Column 8,
Line 13, delete the comma after "to the".
Line 25, delete the comma after "is".
Line 47, delete "contacts" and insert -- contact --, therefor.

Column 9,
Line 21, insert -- the -- after "with".
Line 37, delete "allow" and insert -- allows --, therefor.

Column 10,
Line 9, delete "place" and insert -- placed --, therefor.

Colmn 11,
Line 41, delete "which ever" and insert -- whichever --, therefor.

Column 12,
Line 18, delete "come" and insert -- comes --, therefor.

Column 13,
Line 11, delete "a" after "approximately".

UNITED STATES PATENT AND TRADEMARK OFFICE

CERTIFICATE OF CORRECTION

PATENT NO. : 6,112,690
DATED : September 5, 2000
INVENTOR(S) : Anderson

It is certified that error appears in the above-identified patent and that said Letters Patent is hereby corrected as shown below:

Column 13,
Line 36, delete "First" and insert -- first --, therefor.
Line 64, delete "move" and insert -- moves --, therefor.

Column 14,
Line 14, delete the period after "spring".
Line 34, delete "a" after "approximately".
Line 45, delete "Is" and insert -- is --, therefor.

Column 15,
Line 15, delete "6" and insert -- 16 --, therefor.
Line 44, delete "a" after "approximately".

Column 16,
Line 11, delete "a" after "approximately".
Line 25, delete "liner" and insert -- linear --, therefor.
Line 40, delete "a" after "using".
Line 42, delete "liner" and insert -- linear --, therefor.
Line 45, delete "liner" and insert -- linear --, therefor.

Column 17,
Line 19, delete "rest" and insert -- rests --, therefor.
Line 41, delete "come" and insert -- comes --, therefor.
Line 47, delete "aline" and insert -- align --, therefor.
Line 62, delete "rod" after "steel".

Column 18,
Line 3, delete "to" after "the".
Line 48, delete "secured" and insert -- secure --, therefor.
Line 63, delete the comma after "segment".

Column 19,
Line 10, delete "extend" and insert -- extends --, therefor.
Line 17, delete "rest" and insert -- rests --, therefor.
Line 33, delete "aline" and insert -- align --, therefor.
Line 53, delete "come" and insert -- comes --, therefor.
Line 54, delete "a" and insert -- an --, therefor.

Column 20,
Line 18, delete "liner" and insert -- linear --, therefor.
Line 37, delete "828" and insert -- 826 --, therefor.

UNITED STATES PATENT AND TRADEMARK OFFICE

CERTIFICATE OF CORRECTION

PATENT NO. : 6,112,690
DATED : September 5, 2000
INVENTOR(S) : Anderson

It is certified that error appears in the above-identified patent and that said Letters Patent is hereby corrected as shown below:

Column 20,
Line 37, delete "secured" and insert -- secure --, therefor.

Column 21,
Line 8, delete "to" after "the".
Line 31, delete "a" after "having".

Column 22,
Line 29, delete the comma after "the".
Line 31, delete "a" after "having".

Column 23,
Line 26, delete "axis." and insert
-- axis, said elongated roller adapted for placement into water; and a spring unit mounted to the roller frame, said spring unit allowing the first retaining portion and the second retaining portion to rotate in a plane including the first retaining portion and a second retaining portion. --, therefor.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*